US006005456A

United States Patent [19]

Matsumoto et al.

[11] Patent Number: 6,005,456

[45] Date of Patent: Dec. 21, 1999

[54] DIELECTRIC FILTER HAVING NON-CONDUCTIVE ADJUSTING REGIONS

[75] Inventors: Haruo Matsumoto; Yasuo Yamada; Yukihiro Kitaichi; Tadahiro Yorita; Hideyuki Kato; Tatsuya Tsujiguchi; Hisashi Mori; Hitoshi Tada, all of Nagaokakyo, Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/832,762

[22] Filed: Apr. 4, 1997

Related U.S. Application Data

[62] Division of application No. 08/259,568, Jun. 14, 1994, Pat. No. 5,642,084, which is a continuation of application No. 08/009,308, Jan. 22, 1993, abandoned.

[30] Foreign Application Priority Data

| | | | |
|---|---|---|---|
| Jan. 22, 1992 | [JP] | Japan | 4-9207 |
| Apr. 3, 1992 | [JP] | Japan | 4-29056 |
| Oct. 28, 1992 | [JP] | Japan | 4-312720 |

[51] Int. Cl.[6] ..... H01P 1/201

[52] U.S. Cl. ..... 333/202; 333/206; 333/207

[58] Field of Search ..... 333/206, 207, 333/222, 223, 202 FOR, 202 DB

[56] References Cited

U.S. PATENT DOCUMENTS

| | | | |
|---|---|---|---|
| 4,464,640 | 8/1984 | Nishikawa et al. | 333/202 DB |
| 4,800,348 | 1/1989 | Rosar et al. | 333/223 X |
| 4,837,534 | 6/1989 | Van Horn | 333/223 X |
| 5,572,174 | 11/1996 | Kitaichi et al. | 333/206 |
| 5,642,084 | 6/1997 | Matsumoto et al. | 333/202 |

FOREIGN PATENT DOCUMENTS

| | | | |
|---|---|---|---|
| 81501 | 3/1990 | Japan | 333/202 |

*Primary Examiner*—Benny T. Lee
*Attorney, Agent, or Firm*—Ostrolenk, Faber, Gerb & Soffen, LLP

[57] ABSTRACT

A dielectric filter with integral electromagnetic shielding comprises a dielectric block having an outer surface including first and second end surfaces and a side surface extending between the first and second end surfaces; an external conductor disposed on the outer surface of the dielectric block and providing integral electromagnetic shielding of the dielectric filter; at least one hole extending through the dielectric body between the first and second end surfaces, having a respective inner surface with a substantially constant cross-sectional shape; a respective pair of internal conductors provided in the at least one hole and conductively connected to the external conductor at respective ends of the hole, a respective non-conductive portion in the hole being spaced from both ends and thereby separating the pair of internal conductors and defining a respective capacitance between the pair of internal conductors, a surface of the respective non-conductive portion being substantially flush with the rest of the inner surface of the hole; and signal input and output electrodes provided on the outer surface of the dielectric body and electrically isolated from the external conductor. Conductive and possibly dielectric material is removed from an end surface of the dielectric block to adjust the resonance frequency and/or the coupling degree of the dielectric filter.

24 Claims, 21 Drawing Sheets

DIELECTRIC FILTER HAVING NON-CONDUCTIVE ADJUSTING REGIONS

CROSS-REFERENCE TO RELATED APPLICATIONS

This is a division of application Ser. No. 08/259,568, filed Jun. 14, 1994, now U.S. Pat. No. 5,642,084, which is a continuation of Ser. No. 08/009,308, filed Jan. 22, 1993, abandoned.

BACKGROUND OF THE INVENTION

1. Field of the Invention

The present invention generally relates to dielectric filters having at least one dielectric resonator, the dielectric resonator having an internal conductor which is formed within a dielectric block and an external conductor which is formed on the outside of the dielectric block.

2. Description of Related Art

Filters for use in, for example, the microwave band, include a dielectric filter, in which a resonator electrode is formed within a dielectric block and an earth electrode is formed on the outside face of the dielectric block, and a so-called Triplate (TM) type of dielectric resonator with strip lines located opposite to each other on respective main faces of a dielectric substrate, the strip lines serving respectively as a signal strip line on one main face and an earth electrode on the other main face.

FIG. 39 shows an exploded perspective view of the construction of the conventional general dielectric resonator using a dielectric block. In FIG. 39, reference numeral 40 is a six-sided dielectric block with three internal conductor holes 46, 47, 48 each having an internal conductor provided therein and coupling holes 49, 50 which are provided between the internal conductor holes 46, 47, 48. The internal conductors are formed on the inside surfaces of the internal conductor holes 46, 47, 48, and an external conductor 51 is formed on five faces of the dielectric block 40 except for an open face 52. Reference numerals 53, 54 are so-called resin pins, each being composed of resin portions 53*a*, 54*a* and signal input, output terminals 53*b*, 54*b*. Two resin pins 53, 54 are inserted into the internal conductor holes 46, 48 from the open face side of the dielectric block 40 so that the terminals 53*b*, 54*b* are coupled capacitively to the corresponding internal conductors within the internal conductor holes 46, 48. Reference numeral 55 is a case for retaining the dielectric block 40 and the resin pins 53, 54 and also, for covering the open face portion of the dielectric block 40. The resin pins 53, 54 are respectively inserted into the dielectric block 40 so as to be covered by the case 55, and also, the whole arrangement is integrated by soldering the case 55 to the external conductor 51. For mounting the dielectric resonator on a circuit substrate, the projecting portions 55*a*, 55*b* of the case 55 function as an earth terminal.

As shown in FIG. 39, many components such as input, output terminals 53*b*, 54*b*, case 55 and so on, are necessary if a plurality of resonators are to be formed in a single dielectric block. The assembly steps therefore become complicated. Moreover, it is necessary to attach a lead wire to the component when mounting the completed product on a circuit substrate. Therefore, surface mounting cannot be effected, as it can with other electronic components, so as to mount a plurality of these completed products on the same circuit substrate. Thus, it is difficult to provide an assembly which is low in height.

Further, if the case 55 is not used, the external conductor 51 of the dielectric block 40 is directly connected to the earth electrode on the circuit substrate, so that the open face 52 is exposed, and thus, electromagnetic field leakage occurs at this location. Thus, when a metallic object approaches the open face 52, the metallic object influences this electromagnetic field. Further, since the resonator is coupled with this electromagnetic field, the desired characteristics of the dielectric resonator cannot be obtained.

SUMMARY OF THE INVENTION

Accordingly, the present invention has been developed with a view to substantially eliminating the above discussed drawbacks that are inherent in the prior art, and has for its essential object to provide an improved dielectric resonator.

Another important object of the present invention is to provide an improved dielectric resonator which can be surface mounted on the circuit substrate without the use of resin pins 53, 54 and a case 55 as individual parts, as required by the prior art device shown in FIG. 39.

Still another object of the present invention is to provide a dielectric resonator in which electromagnetic field leakage between the inside and the outside of the resonator near the opening portion is reduced, so as to remove the problem caused by the above described electromagnetic field leakage.

A further object of the present invention is to provide a dielectric resonator in which it is easier to obtain floating capacitance by a comparatively simple working or molding operation.

In accomplishing these and other objects, a dielectric resonator in accordance with a first aspect of the invention is provided having a non-conductive portion formed in at least one internal conductor near one end face of the above described dielectric block, and signal input, output electrodes for providing capacitive connection with the above described internal conductor are provided on the outer surface of the dielectric block. The dielectric resonator includes at least one internal conductor hole, or a plurality of internal conductor holes, within the dielectric block, the external conductor being formed on the outside of the above described dielectric block.

In the dielectric resonator of the first aspect of the invention, the non-conductive portion in the internal conductor hole is provided near one end face of the at least one hole, or the plurality of holes, of the dielectric resonator, and the signal input, output electrodes effect capacitive connection with the internal conductor. A tip end capacitance is created at the non-conductive portion in the at least one internal conductor hole so as to provide comb-line coupling or interdigital coupling between the adjacent resonators. In this construction, the conductor is not removed from either end face of the dielectric body, so that large electromagnetic field leakage is avoided.

As coupling holes are not required, the whole arrangement can easily be made smaller in size. As the signal input, output electrodes are provided so as to provide a capacitive connection with the internal conductor, the signal input, output terminals are not required to be separate, individual parts. The external conductor can be connected with the earth electrode on the circuit substrate by surface mounting, and also, the signal input, output electrodes can be similarly connected with the signal line on the circuit substrate.

A dielectric resonator of a second aspect of the invention described in accordance with the first aspect of the invention is characterized in that the above described dielectric filter is an approximately six-sided unit and the above described signal input, output electrodes may be formed only on a circuit substrate mounting face thereof.

In the dielectric resonator of the second aspect of the invention, the above described signal input, output electrodes may be formed only on the mounting face which is to be mounted to the circuit substrate. Therefore, electromagnetic field leakage of the signal input, output electrodes is reduced when the dielectric resonator is mounted on the substrate, the resonator characteristics are less changed by the influence of external metallic objects, and no unnecessary connections with other circuit portions are required, thereby simplifying the circuit design and assembly operation. Further, pattern formation on the circuit substrate is simplified, because the signal input, output electrodes are formed within one plane.

In a dielectric resonator of a third aspect of the invention, the non-conductive portions in the internal conductor holes are formed by removing one portion of the internal conductor from a location near the end face of the dielectric block but spaced from the end face. In the dielectric resonator of the third aspect of the invention, as the non-conductive portion is spaced from the end face of the resonator, the electromagnetic field leakage is further reduced.

A dielectric resonator of a fourth aspect of the invention has a plurality of internal conductors formed in holes within a dielectric block, an external conductor is formed on the outside of the dielectric block, one end face of the above-described dielectric block being a short-circuit face where the internal conductors within the holes are short-circuited, the other end face of the dielectric block being referred to as an open-circuit face. A portion of a resonator hole where no internal conductor is formed is provided near the open-circuit face so as to provide an open-circuited end of said resonator. Signal input and output electrodes for providing capacitive connections with the above-described conductors are provided on one portion of the external conductor. Moreover, portions of the external conductor and the dielectric are removed from portions of the above-described short-circuit face, the above-described open-circuit face, or both the faces.

In the dielectric resonator of the fourth aspect of the invention, as just described, there are portions at one portion of the open-circuit face where the external conductor and the dielectric are not formed, near the portion of the resonator hole where no internal conductor is provided; or on the short-circuit face; or on both the faces. If portions of the conductor and the dielectric are removed from the open-circuit face, near where a portion of the internal conductor is not provided, the resonance frequency of the resonator can be raised. If the conductor and the dielectric are removed between adjacent holes in the short-circuit face, the coupling between the resonators is weakened, and also, the resonance frequency of the resonator can be lowered. If the conductor and the dielectric are removed around the holes, except for between the adjacent holes, the resonance frequency of the resonator can be lowered. Therefore, adjustments of the coupling and the frequency can be easily effected without measures such as the addition of conductive coatings and so on in the portion of the hole where no internal conductor is provided.

BRIEF DESCRIPTION OF THE DRAWINGS

These and other objects and features of the present invention will become apparent from the following description of embodiments thereof with reference to the accompanying drawings, in which.

DETAILED DESCRIPTION OF EMBODIMENTS OF THE INVENTION

Figure 1:
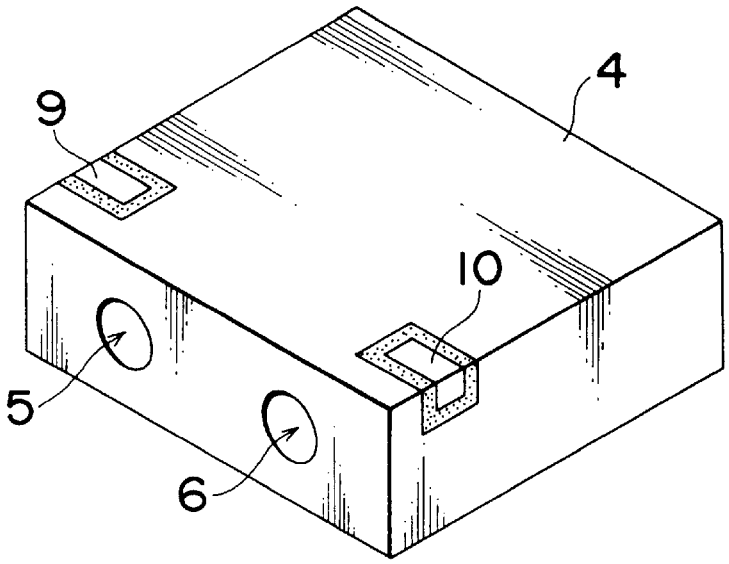
FIG. 1 is a perspective view of a dielectric resonator which is made in accordance with a first embodiment.

Before the description of embodiments of the present invention proceeds, it is to be noted that like parts are designated by like reference numerals throughout the accompanying drawings.

(First Embodiment)

The construction of a dielectric resonator and a characteristic adjusting method thereof in a first embodiment of the present invention will be described hereinafter in accordance with FIG. 1 through FIG. 6.

FIG. 1 is a perspective view of a dielectric resonator. In FIG. 1, reference numerals 5, 6 are holes having an internal conductor provided therein, hereinafter referred to as internal conductor holes. The internal conductor holes 5, 6 are formed in a dielectric block having generally six sides. The internal conductor is formed in advance on the inside surfaces of the internal conductor holes 5, 6. An external conductor 4 as shown in FIG. 1, is formed on all six of the outside faces of the dielectric block. Signal input, output electrodes, shown by reference numerals 9, 10, are formed in the respective portions of the external conductor 4, as shown in FIG. 1.

Figure 2:
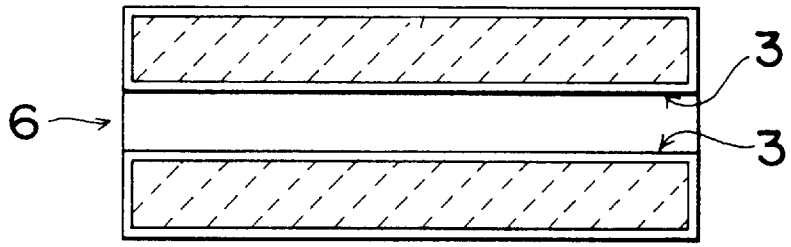
FIG. 2 is a sectional view of the dielectric resonator which is made in accordance with the first embodiment.
Figure 3:
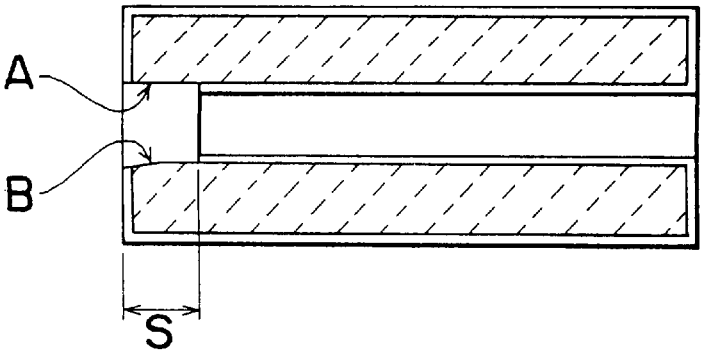
FIG. 3 is a sectional view of a dielectric resonator in accordance with the first embodiment after removal of a portion of the inner conductor.
Figure 4:
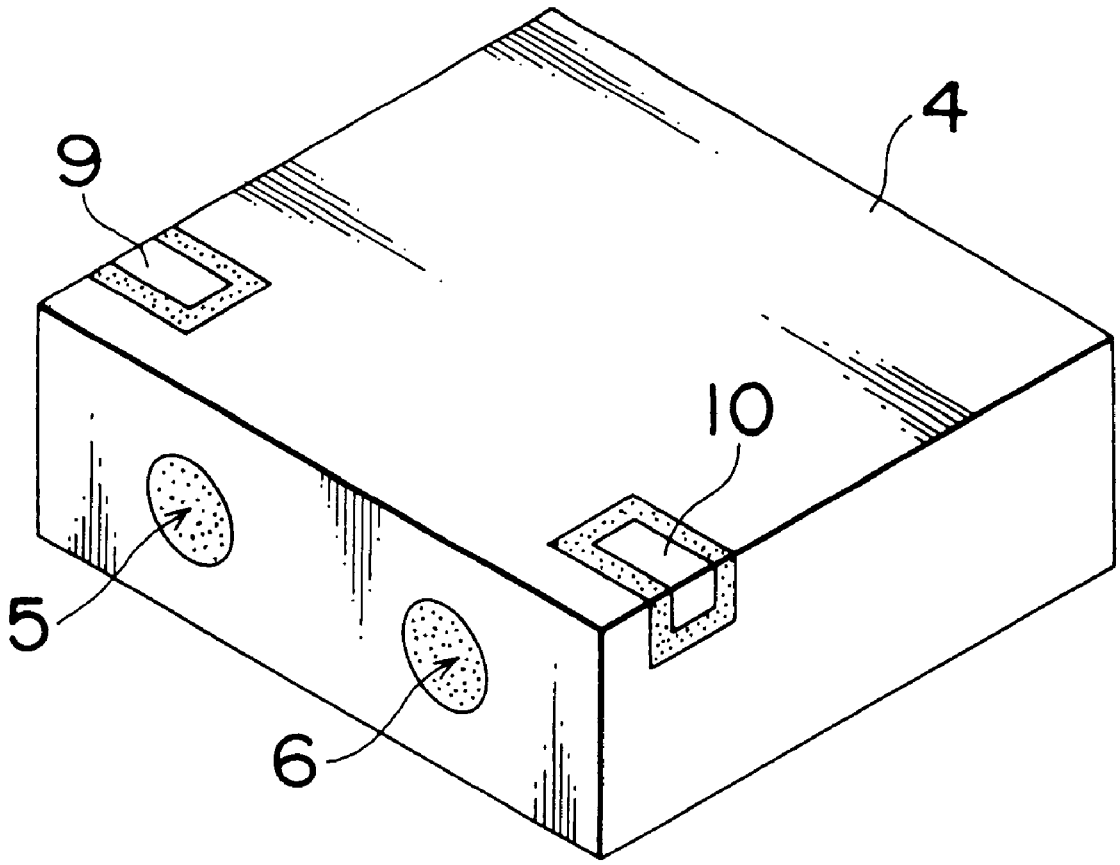
FIG. 4 is a perspective view of a dielectric resonator in accordance with the first embodiment after removal of a portion of the inner conductor.
Figure 5:
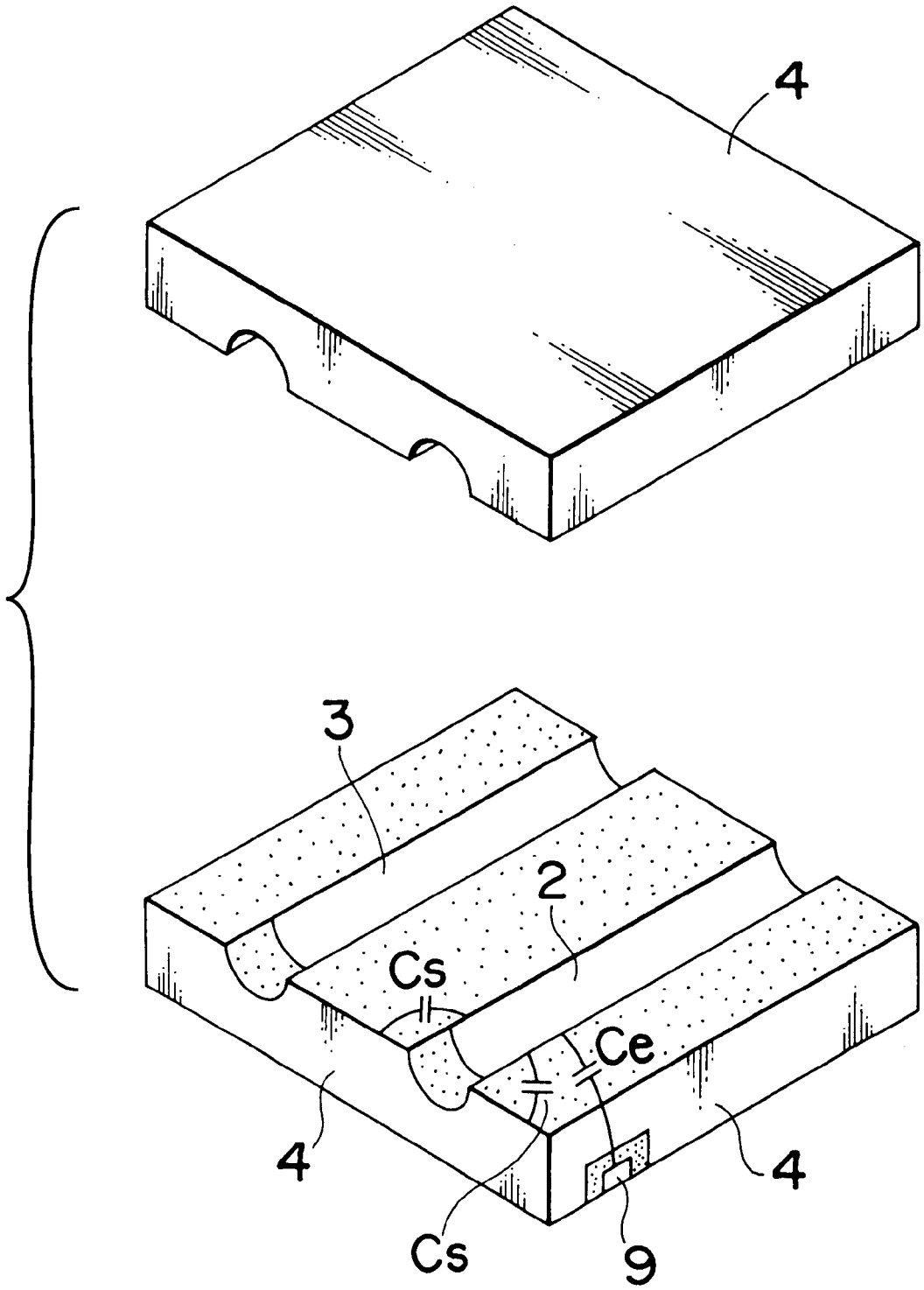
FIG. 5 is an exploded perspective view of the dielectric resonator in accordance with the first embodiment.

FIG. 2 is a vertical sectional view passing through the internal conductor hole 6 in FIG. 1. An internal conductor, shown by reference numeral 3, is formed on the entire inside face of the internal conductor hole 6. A non-conductive portion (hereinafter referred to as an open portion) of the inner conductor is provided on one portion of the internal conductor hole in order to obtain a dielectric resonator having desired resonating characteristics in such a dielectric block. As shown in FIG. 3, the internal conductor is removed near one end of each of the internal conductor holes 5, 6 so as to adjust the resonance frequency and the coupling degree of the dielectric resonator. FIG. 4 is a perspective view showing a dielectric resonator after the open portion is formed, FIG. 3 being a vertical sectional view thereof. In FIG. 3, the open portion is formed by removing the internal conductor near the opening of the internal conductor hole, shown with the letters A, B. FIG. 5 is a view in which the dielectric resonator shown in FIG. 4 has been cut and separated at a central horizontal face. The signal input, output electrodes 9, 10 face downward. A tip end capacitance Cs is created, between the tip end portion of the internal conductor 2 and the external conductor 4, in the open portion of, for example, the internal conductor 2, and an external coupling capacitance Ce is created between the tip end portion vicinity of the internal conductor 2 and the signal input, output electrode 9. The tip end capacitance is adjusted according to a size S, shown in FIG. 3, of the open portion, thereby adjusting the coupling degree and the resonance frequency of the resonator.

Figure 6:
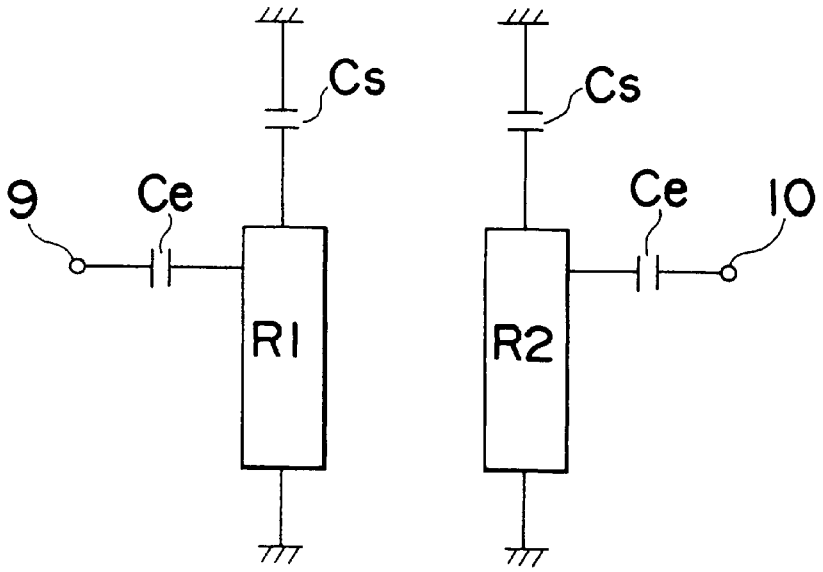
FIG. 6 is an equivalent circuit diagram of the dielectric resonator in accordance with the first embodiment.

FIG. 6 is an equivalent circuit diagram of the dielectric resonator shown in FIG. 1 through FIG. 5. In FIG. 6, reference character R1 is a resonator with the internal conductor 2, reference character R2 is a resonator with the internal conductor 3. Reference character Ce is an external coupling capacity that is formed between the signal input, output electrodes 9, 10 and the open portions of the internal conductors 2, 3.

(Second Embodiment)

Figure 7A:
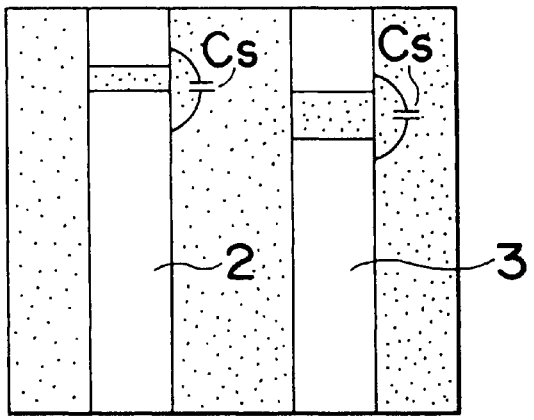
FIGS. 7(A) and 7(B) show the construction of a dielectric resonator in accordance with a second embodiment, FIG. 7(A) being a horizontal sectional view and FIG. 7(B) being a front end view.
Figure 7B:
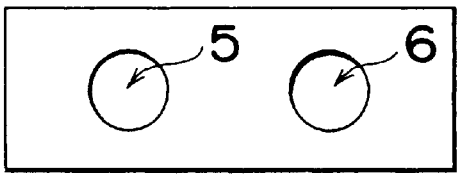

The construction of a dielectric resonator in a second embodiment, which is different in the position of the open portion formed within the internal conductor hole, is shown in FIGS. 7(A) and 7(B). FIG. 7(A) is a central horizontal sectional view of a dielectric block and FIG. 7(B) is a front end view seen from one short-circuited end of the dielectric block. The open portions of the internal conductors 2, 3, which are provided within the internal conductor holes 5, 6 are situated in locations spaced away from the openings of the internal conductor holes 5, 6 so as to form the tip end capacitance Cs in the open portions. Thus, electromagnetic field leakage can be further reduced.

(Third Embodiment)

Figure 8:
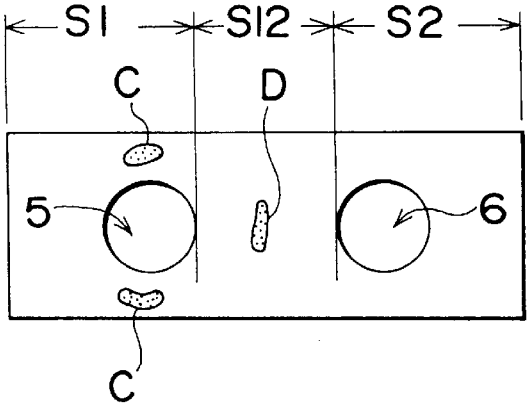
FIG. 8 is a front end view of a dielectric resonator in accordance with a third embodiment.
Figure 9:
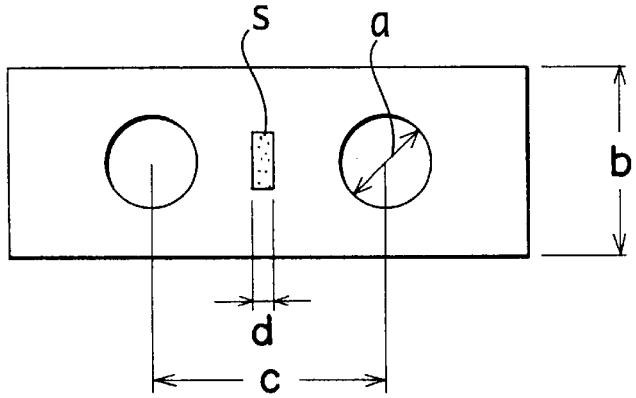
FIG. 9 is a front end view showing a dielectric resonator with a conductor removed for the measurement of characteristics of the dielectric resonator in accordance with the third embodiment.
Figure 10:
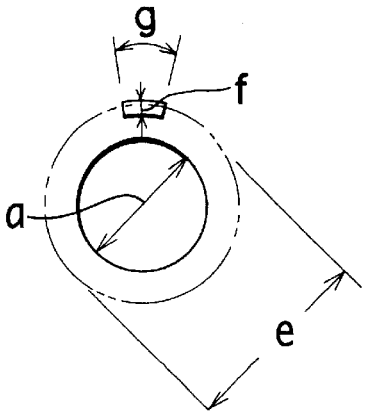
FIG. 10 is a partial front end view showing a dielectric resonator with a conductor removed for the measurement of characteristics of the dielectric resonator in accordance with the third embodiment.

FIGS. 8–10 shows the construction of a dielectric resonator in accordance with a third embodiment in which the resonance frequency and the coupling degree have been adjusted by the provision of a non-conductive portion in the external conductor and the dielectric in one portion of the short-circuited end. FIG. 8 is an end view seen from the short-circuited end, with reference characters C, D being non-conductive portions in the external conductor and the dielectric of the short-circuited end. The resonance frequency of the resonator formed by the internal conductor hole 5 is lowered by the partial removal of the conductor and the dielectric in the region S1 in FIG. 8. Similarly, if the conductor and the dielectric are partially removed in the region S2, the resonance frequency of the resonator formed by the internal conductor hole 6 is lowered. The coupling degree between the two resonators is lowered if the conductor and the dielectric are partially removed in the region S12.

Figure 11:
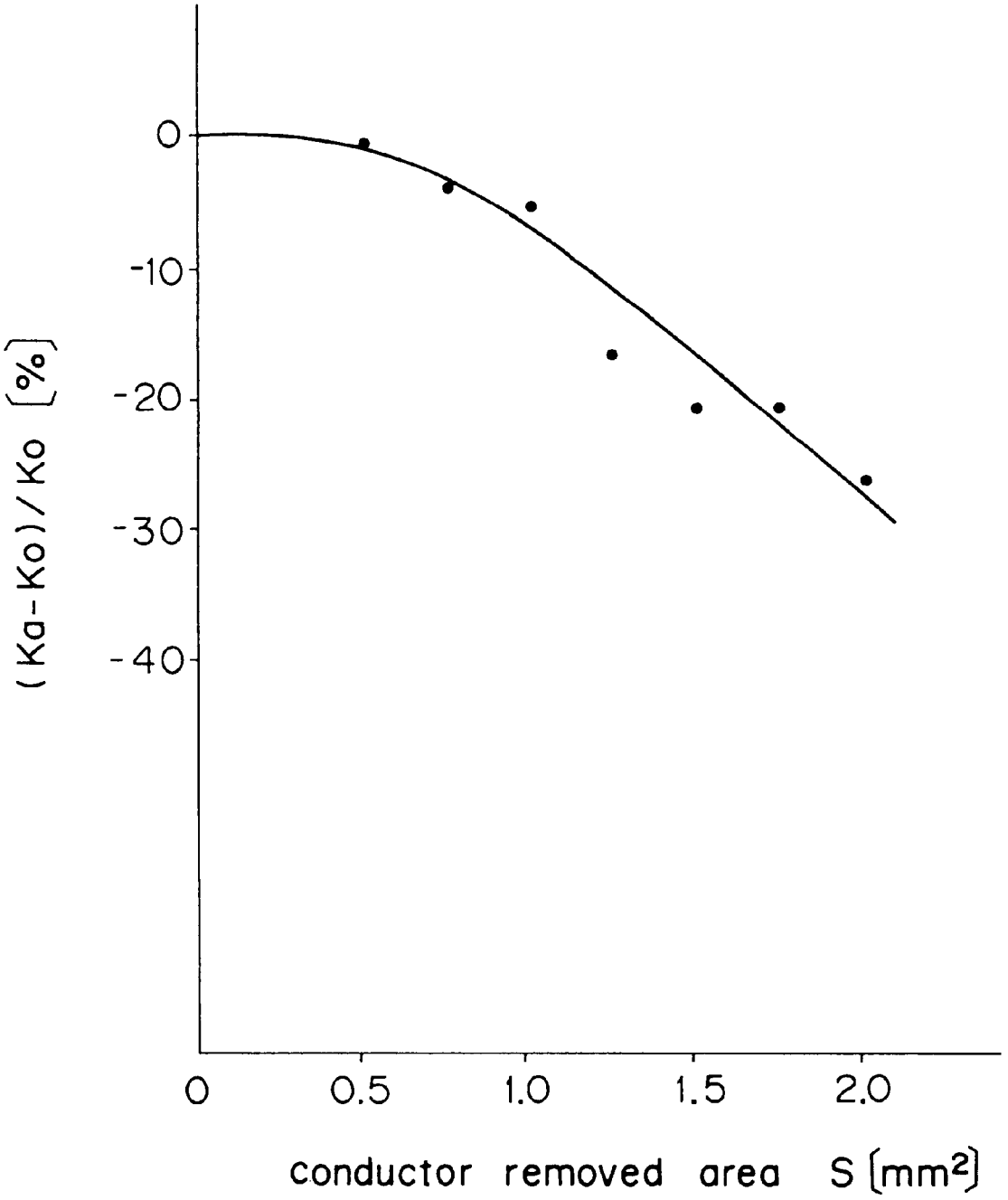
FIG. 11 is a graph showing the results of measuring coupling coefficient changes in the dielectric resonator in accordance with the third embodiment.

A modified embodiment wherein the coupling coefficient is modified by the removal of the conductor and the dielectric is shown in FIG. 9 and described in FIG. 11. A conductor removal portion of a width d is provided in a middle position between two resonator holes, as shown in FIG. 9. Changes in the coupling coefficient as a function of the conductor removal area S are measured. In FIG. 9, a=2.0 mm, b=4.0 mm, c=5.0 mm. FIG. 11 shows the change ratio of the coupling coefficients with the abscissa indicating the conductor removal area S, and the ordinate indicating the ratio of change in the coupling coefficient with Ko being the coupling coefficient in the case of S=0 and Ka being the coupling coefficient after the conductor removal. The coupling coefficient can be adjusted by adjusting the conductor removal areas between the internal conductor holes on the short-circuited end.

Figure 12:
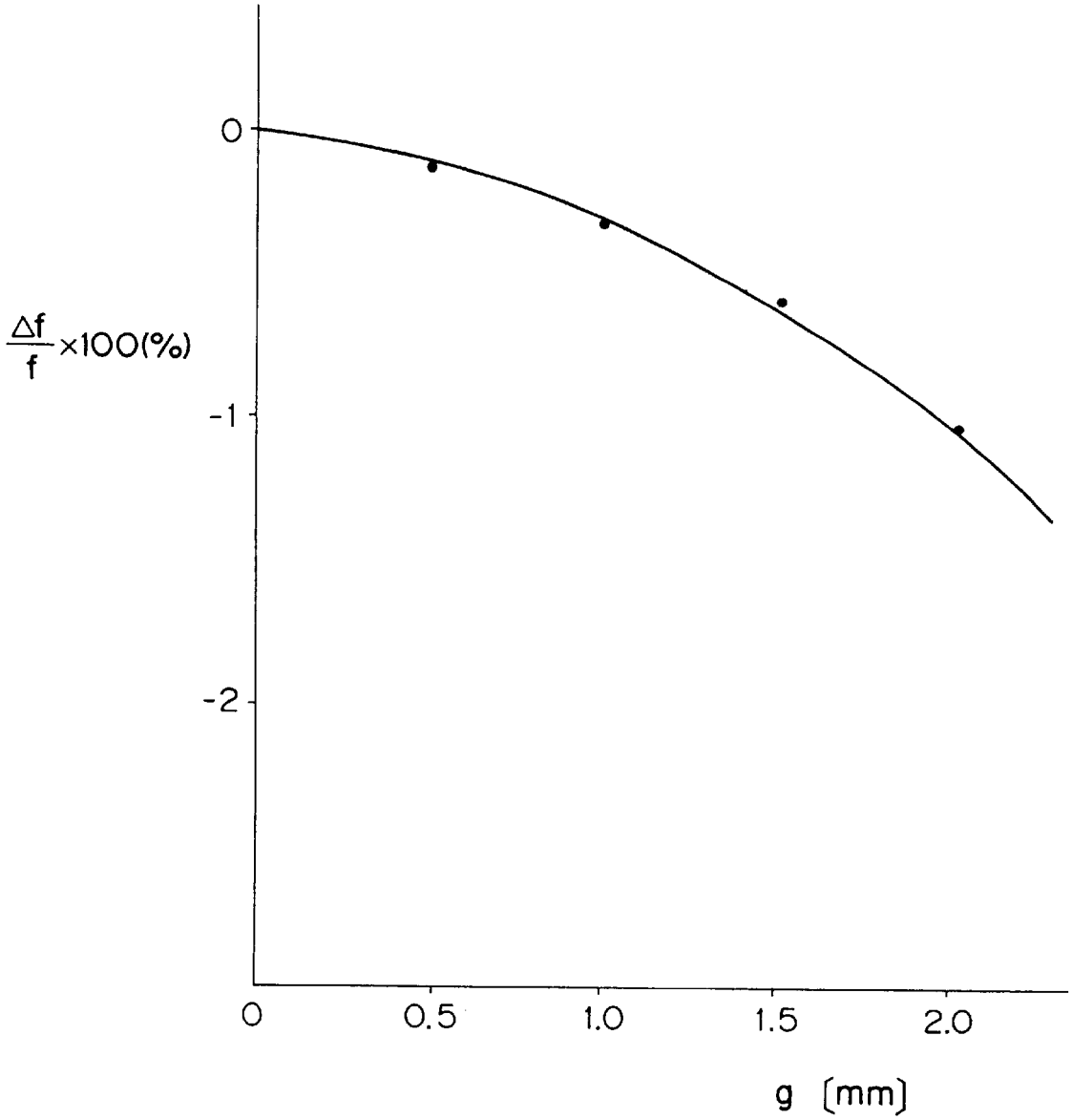
FIG. 12 is a graph showing the results of measuring resonance frequency changes in the dielectric resonator in accordance with the third embodiment.

FIG. 10 and FIG. 12 show and describe an example of adjusting the resonance frequency. A conductor removal portion of a length g with a width f is provided, in a location spaced away at a given distance from the internal conductor hole, as shown in FIG. 10, and the resonance frequency is measured when the length g is changed. In FIG. 10, a=2.0 mm, e=3.0 mm, f=0.5 mm. In FIG. 12, the abscissa shows the length g of the conductor removal portion, and the ordinate shows the amount of variation in the resonance frequency with the resonance frequency in the case of g=0 being a reference. Accordingly, the resonance frequency can be adjusted by adjusting the conductor removal portion near the periphery of the internal conductor hole on the short-circuited end.

Figure 40:
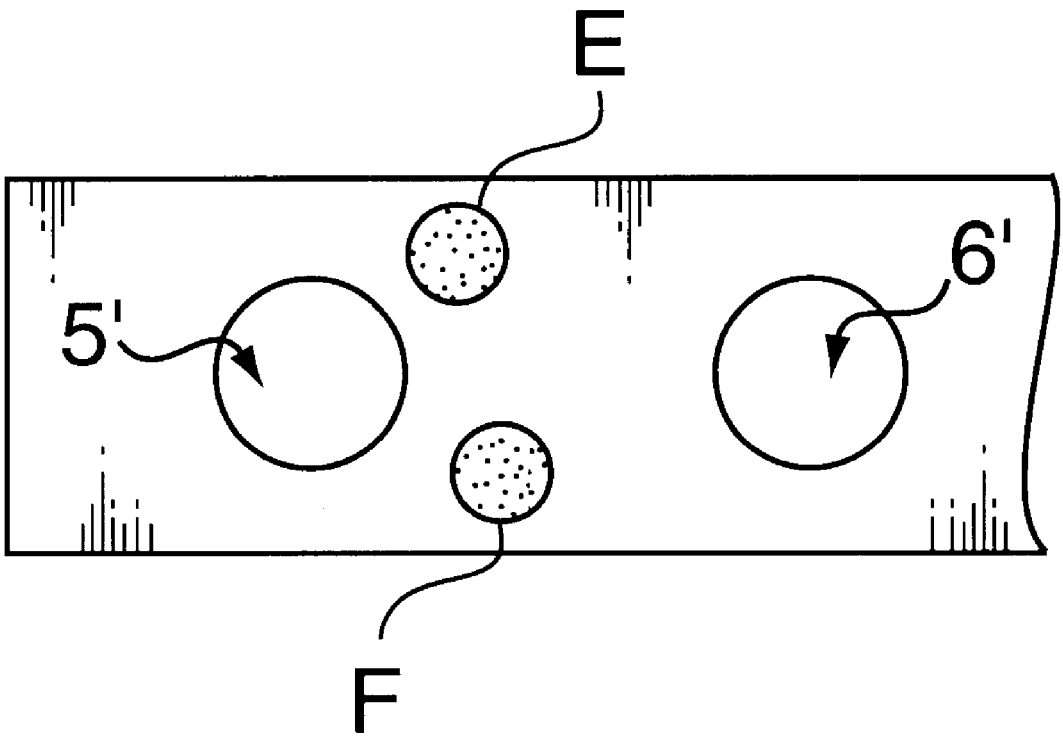
FIG. 40 is a partial end view of a dielectric resonator illustrating a variation of the third embodiment of FIGS. 8–10.

In addition, as shown at E and F in FIG. 40, the conductor and the dielectric can also be removed on the other face, near the non-conductive portions of the holes 5' and 6', and the capacitance Cs thereby decreased, so that the resonance frequency can be adjusted to be even higher.

(Fourth Embodiment)

Figure 13:
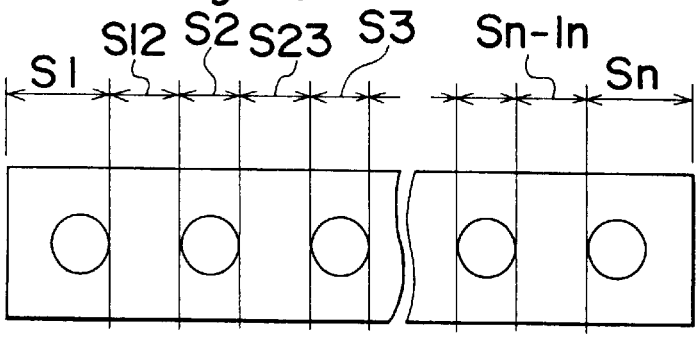
FIG. 13 is a front end view of a dielectric resonator in accordance with a fourth embodiment.

Although two stages of dielectric resonator are shown in the examples shown in FIG. 8 through FIG. 12, the same features can be applied even to a dielectric resonator of three or more stages, as shown in FIG. 13. The coupling degree between each two resonators (indicated by circles) in the embodiment of FIG. 13 is adjusted by the partial removal of the conductor and the dielectric in the areas S12, S23, . . . $S_{(n-1)(n)}$ among the openings of the internal conductor holes on the short-circuit face as shown in FIG. 13. The resonance frequency of the respective resonators can be adjusted by the partial removal of the conductor and the dielectric in the regions S1, S2, S3 . . . Sn, shown in FIG. 13.

(Fifth Embodiment)

Figure 14:
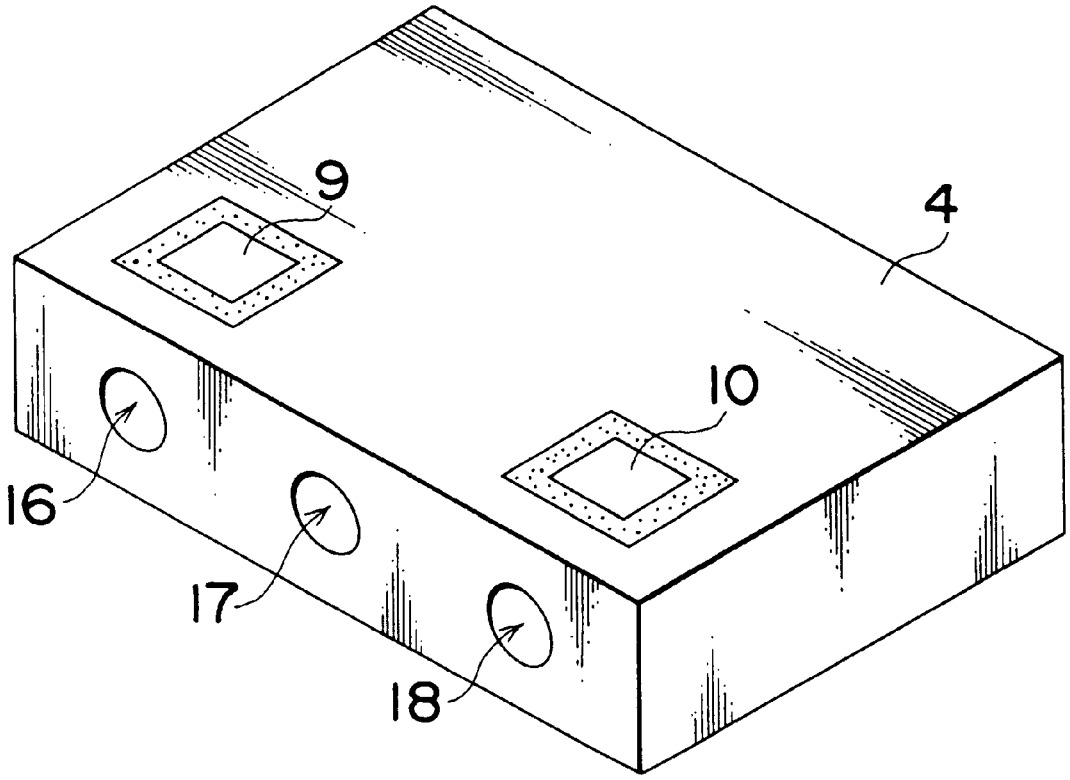
FIG. 14 is a perspective view of a dielectric resonator in accordance with a fifth embodiment.

The construction of a dielectric resonator in a fifth embodiment, which is different in the shape of the signal input, output electrodes, is shown in FIG. 14, which is a perspective view. In FIG. 14, reference numerals 16, 17, 18 are internal conductor holes with the internal conductor and the open portions thereof being formed on the inside surfaces of the holes 16, 17, 18. External conductor 4 is provided on the outside face of the dielectric block, with the signal input, output electrodes 9, 10 being formed only on the top face as shown in the drawing. The electrode 9 is coupled capacitively to the internal conductor within the internal conductor hole 16, and the electrode 10 is coupled capacitively to the internal conductor within the internal conductor hole 18. When the dielectric resonator is mounted on a circuit substrate, the top face as shown in the drawing is positioned so as to be opposed and adhered to the mounting surface of the circuit substrate.

(Sixth Embodiment)

The construction of a dielectric resonator and its characteristic adjusting method in accordance with a sixth embodiment will be described hereinafter with reference to FIG. 15 through FIG. 19.

Figure 15:
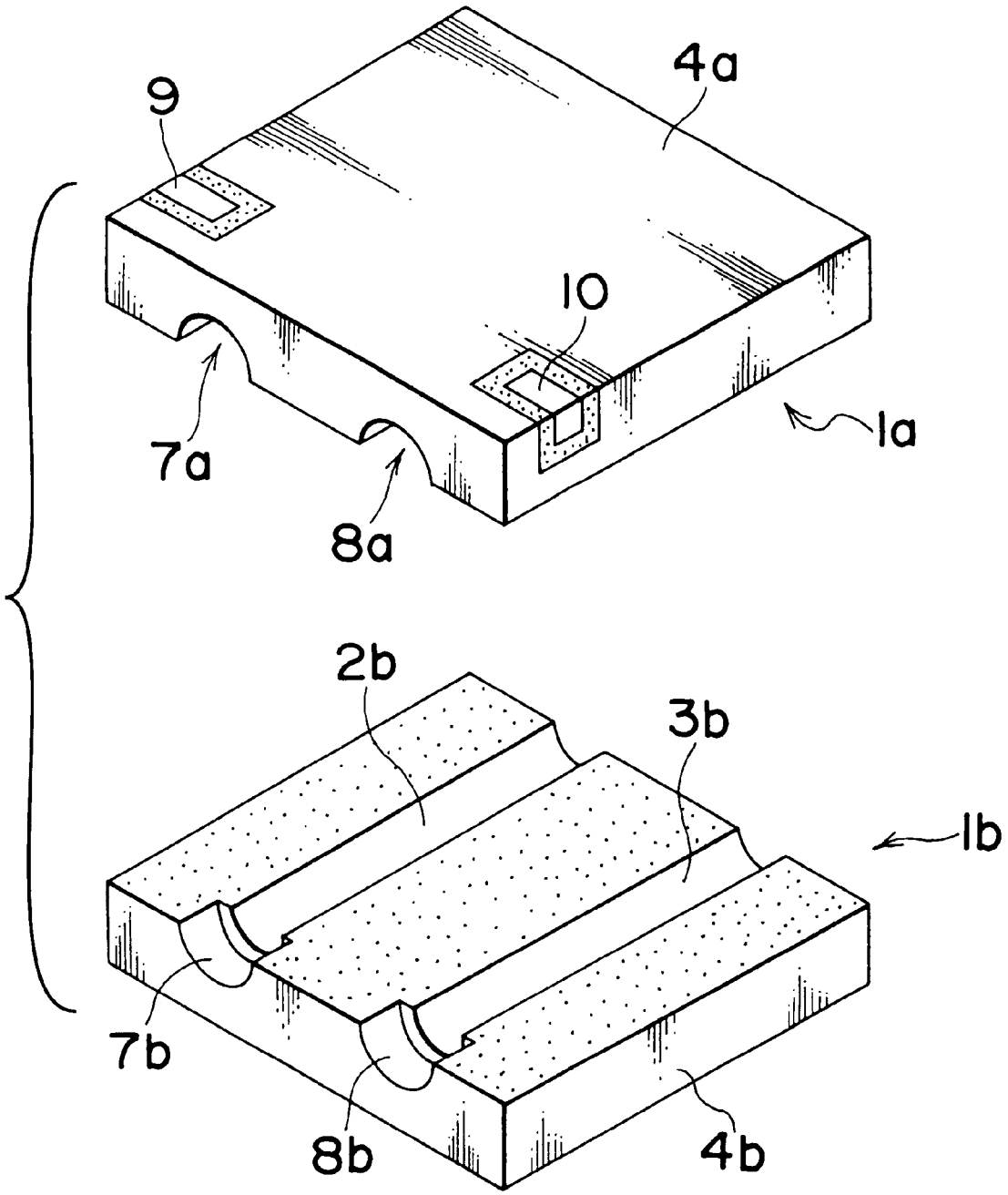
FIG. 15 is an exploded perspective view of a dielectric resonator in accordance with a sixth embodiment.

FIG. 15 is an exploded perspective view of the dielectric resonator. In FIG. 15, reference numeral 1*a*, 1*b* are, respectively, dielectric plates. Two semicircular grooves are formed, respectively, on one main face of each of the dielectric plates 1*a*, 1*b* and the internal conductors are formed on inside faces thereof. Reference numerals 2*b*, 3*b* are internal conductors provided on the inside of the grooves of the dielectric plate 1*b*. Hollowed out portions or hollows 7*a*, 8*a* and 7*b*, 8*b* are formed at ends of the grooves of the dielectric plates 1*a*, 1*b*, respectively. An external conductor 4*a* is provided on the other main face, opposite to the main face with the internal conductors, and the four side faces of the dielectric plate 1*a*. An external conductor 4*b* is similarly provided on the other main face, opposite to the face with the internal conductors formed thereon, and the four side faces of the dielectric plate 1*b*. Signal input, output electrodes 9, 10 are formed in the external conductor 4*a* of the dielectric plate 1*a*, as shown in FIG. 15.

Figure 16:
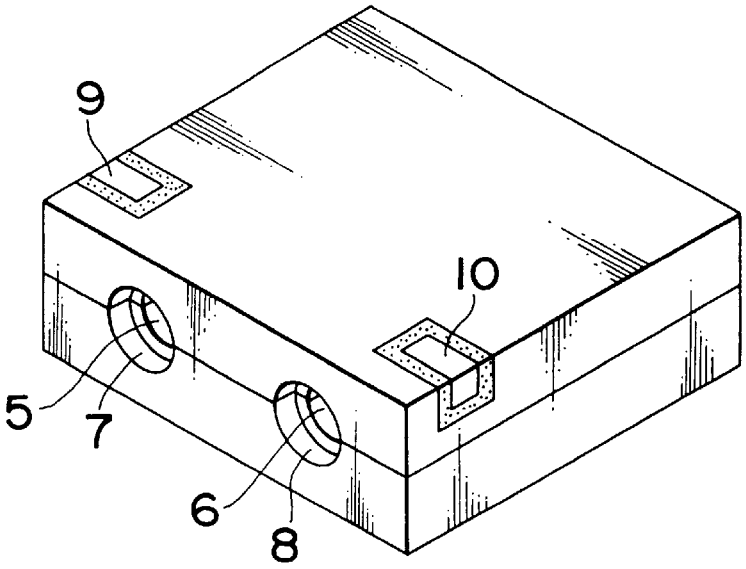
FIG. 16 is a perspective view of the dielectric resonator in accordance with the sixth embodiment.

FIG. 16 shows a dielectric resonator before characteristic adjustment. The two dielectric plates 1*a*, 1*b*, shown in FIG. 15, are connected with the internal conductors formed thereon so as to oppose each other. Circular shaped internal conductor holes 5, 6 are constructed by the combination of the semi-circular shaped grooves shown in FIG. 15. The step shaped hollows 7, 8 shown are constructed by the combination of the hollows 7*a*, 7*b* and 8*a*, 8*b* formed on the dielectric plates 1*a*, 1*b*. The dielectric resonator, shown in FIG. 16, is mounted after characteristic adjustment with the top face shown in the drawing being in contact against the circuit substrate.

Figure 17:
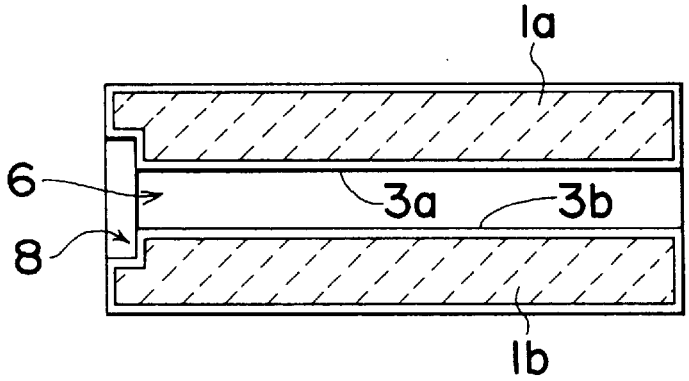
FIG. 17 is a sectional view of the dielectric resonator in accordance with the sixth embodiment.

FIG. 17 is a sectional view through the internal conductor hole 6 of the dielectric resonator shown in FIG. 16.

Figure 18:
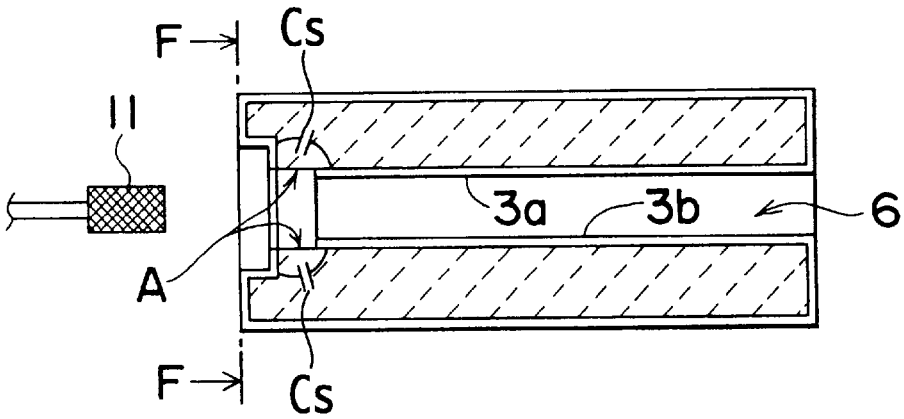
FIG. 18 is another sectional view of the dielectric resonator in accordance with the sixth embodiment.
Figure 19:
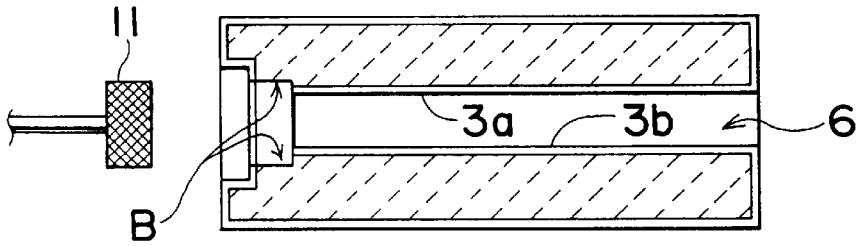
FIG. 19 is yet another sectional view of the dielectric resonator in accordance with the sixth embodiment.

FIG. 18 and FIG. 19 are two embodiments where an open portion is formed in one portion of the internal conductor and the resonator characteristics are thereby adjusted. In FIG. 18, reference character A shows locations where the respective portions of internal conductors 3*a*, 3*b* are removed near the hollow formed portions. More specifically, grinding tools are used such as a router, with a grindstone, cylindrically shaped as shown by reference numeral 11, mounted thereon. As the removed portion A of the internal conductor is formed in a location spaced away from the open face F as shown in FIG. 18, electromagnetic field leakage from the open face F with respect to the interior is reduced, and the resonator is hardly influenced by its electromagnetic field extending outside the resonator periphery. That is, even if a metallic object is located near the open face F, the characteristics of the resonator are not disturbed by the electromagnetic field of the resonator interacting with the metallic object.

When the adjusting operation is conducted with a grinding tool as shown in FIG. 18, the amount removed of the internal conductors 3*a*, 3*b* is controlled by the insertion depth of the grinding tool so that the tip end capacitance can be easily adjusted. As the resonator frequency and the degree of coupling with the adjacent resonators change if the tip end capacitance changes, the desired resonator characteristics are obtained by adjusting the insertion depth of the grinding tool with respect to the internal conductor hole. As shown in FIG. 18, a large tip end capacitance is formed in the open portion of the internal conductor, which makes the coupling degree between the resonators large so as to easily make the bandwidth broader.

FIG. 19 shows another characteristic adjustment method. In FIG. 19, reference character B shows locations where the dielectric has been removed together with the internal conductor near the hollow portion formed near one opening of the internal conductor hole 6. A cylindrical grinding tool 11, which is provided with a grindstone having an outer diameter larger than the inside diameter of the internal conductor hole, is used so as to grind the dielectric together with the internal conductor. Accordingly, the grinding tool is inserted in an axial direction from the hollow formed portion with the grinding tool being set at the center of the bore of the internal conductor hole so that the dielectric together with the internal conductor can be easily ground and removed by a fixed amount.

(Seventh Embodiment)

Figure 20:
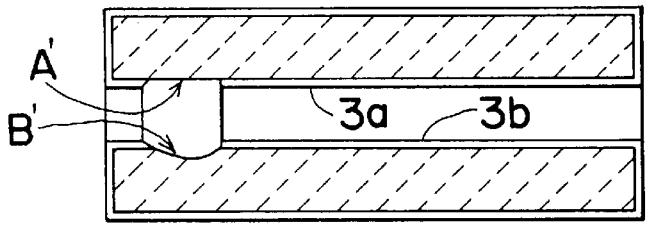
FIG. 20 is a sectional view of a dielectric resonator in accordance with a seventh embodiment.

FIG. 20 shows a sectional view of a dielectric resonator in accordance with a seventh embodiment. In FIG. 20, reference characters A, B show the locations of removed portions of the internal conductors. One portion of the internal conductor is grounded, near the opening of the internal conductor hole, in a location spaced away from the opening face, so that the open portion of the internal conductor is formed at a location spaced away from the open end face of the dielectric resonator. Accordingly, the problem caused by electromagnetic field leakage is removed.

A grinding tool, provided with a grindstone of comparatively small diameter, is used for formation and adjustment of such an open portion so that the inserting and boring operations can be effected obliquely from the open portion. At the same time, one portion of the dielectric is also grounded, as shown by letter B in FIG. 20, and the tip end capacitance can be adjusted by adjusting the depth thereof.

(Eighth Embodiment)

The construction of a dielectric resonator and its characteristics adjusting method in an eighth embodiment will be described hereinafter in accordance with FIG. 21 and FIG. 22.

Figure 21:
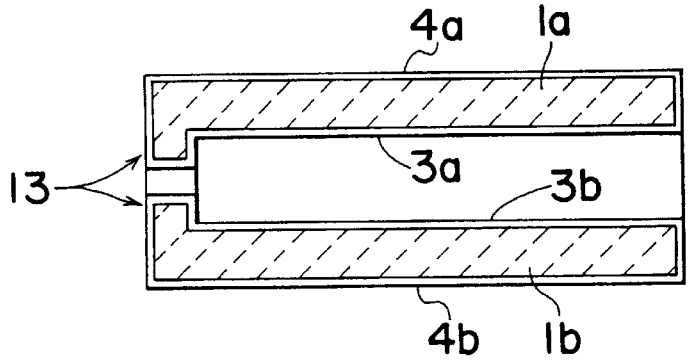
FIG. 21 is a sectional view of a dielectric resonator in accordance with an eighth embodiment.

FIG. 21 is a sectional view through an internal conductor hole portion of the dielectric resonator. The construction is different from the sixth embodiment although it is related to the construction of FIG. 15 and FIG. 16. A narrowed throttle portion 13 is formed at one opening of the internal conductor hole. Internal conductors 3*a*, 3*b* are formed on the inside surface of the internal conductor hole and external conductors 4*a*, 4*b* are provided on the outside surface of the dielectric resonator, as shown in FIG. 21. A conductor film, which is continuous with the external conductor and the internal conductor, is formed on the inside surface of the throttle portion 13.

Figure 22:
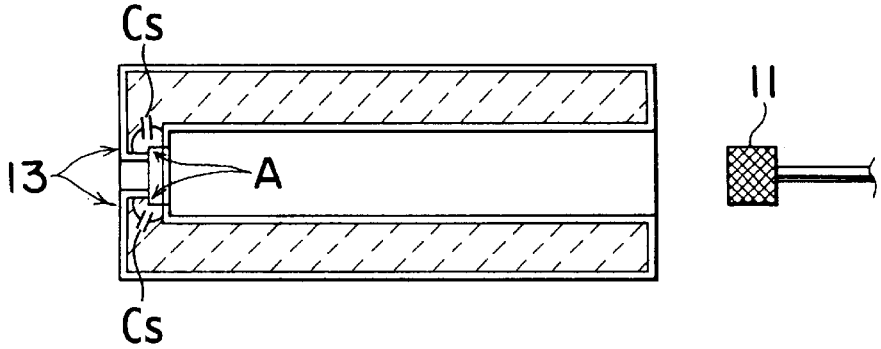
FIG. 22 is a sectional view of the dielectric resonator in accordance with the eighth embodiment.
Figure 23:
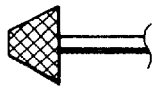
FIG. 23 is a view showing the shape of a grindstone.
Figure 24:
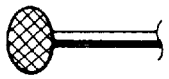
FIG. 24 is a view showing the shape of another grindstone.

FIG. 22 is a view showing an example of the formation of an open portion and an adjusting method. In FIG. 22, reference character A shows the locations of the removed portions of the internal conductor and the dielectric. One portion of the internal conductor is removed from the throttle portion 13 on the side adjacent the internal conductor hole, whereby the open portion of the internal conductor is formed in a location spaced away from the open face. Therefore, electromagnetic field leakage is reduced. In order to form such an open portion, so as to effect characteristic adjustment, a cylindrical grindstone 11 on a router is inserted into the opening of the internal conductor hole at the end away from the throttle portion 13 so as to adjust the grinding amount by adjusting the insertion depth thereof, as shown in FIG. 22. The proportion of change of the tip end capacitance with respect to the insertion amount of the grindstone is dependent on the tip end shape of the grindstone. A truncated-conical grindstone as shown in FIG. 23 and an oval-shaped grindstone as shown in FIG. 24 may be used, considering the desired amount and the desired accuracy of the characteristic adjustment.

(Ninth Embodiment)

The construction and adjustment method of a dielectric resonator in accordance with a ninth embodiment will be described hereinafter in accordance with FIG. 25 through FIG. 27.

Figure 25:
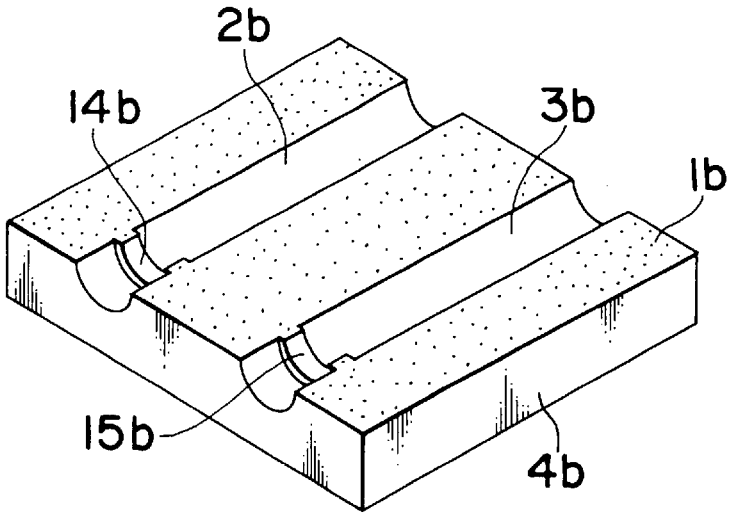
FIG. 25 is a perspective view of one dielectric plate for use in constructing a dielectric resonator in accordance with a ninth embodiment.

FIG. 25 shows one plate for forming a dielectric resonator. In FIG. 25, reference character 1*b* is a dielectric plate. Two semicircular (sectional) grooves are formed on one main face of the dielectric plate 1*a* with internal conductors 2*b*, 3*b* being formed on the inside faces thereof. Semicircular sectional portions 14*b*, 15*b* of the throttle portion are formed in one portion of each groove. An external conductor 4*b* is formed on the other main face, opposite to the internal conductor, and the four side faces of the dielectric plate 1*b*. A dielectric resonator is formed with two plates, which are shaped the same as the plate shown in FIG. 25, connected opposite to each other.

Figure 26:
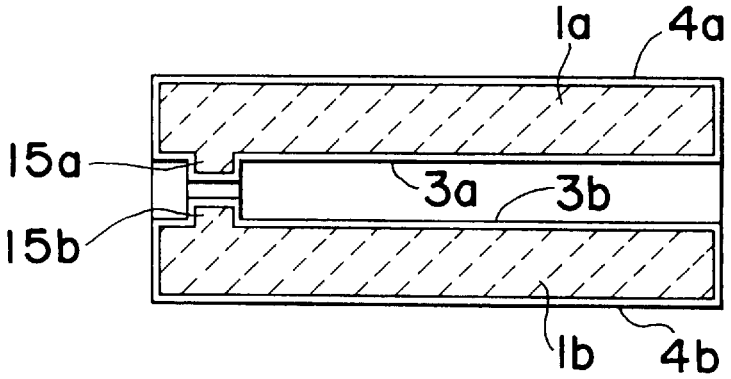
FIG. 26 is a sectional view of the dielectric resonator of the ninth embodiment.
Figure 27:
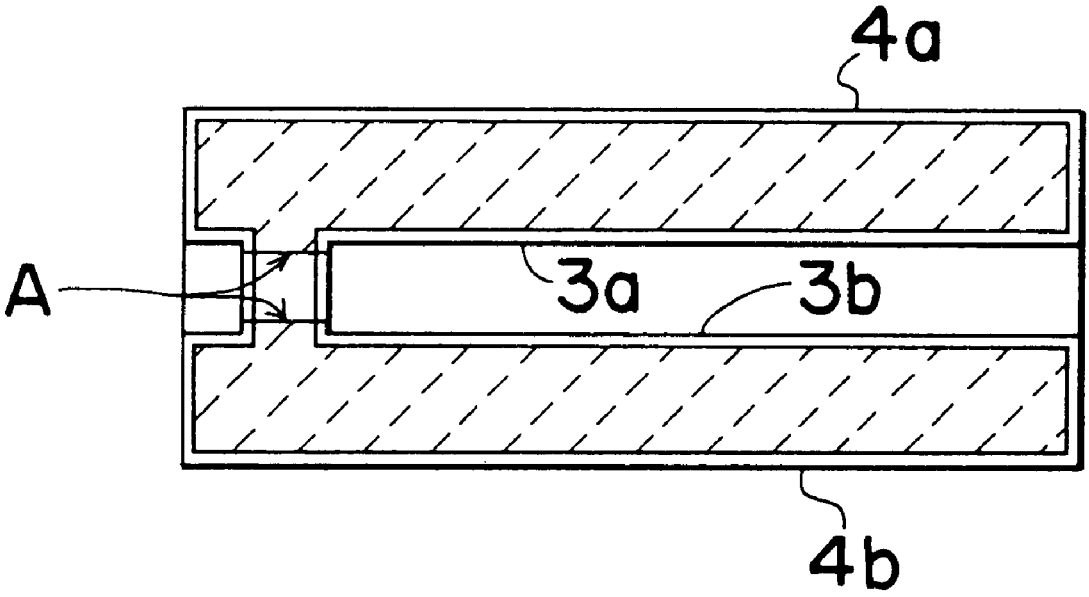
FIG. 27 is a sectional view of the dielectric resonator in accordance with the ninth embodiment.

FIG. 26 is a sectional view thereof. In FIG. 26, reference numerals 15*a*, 15*b* indicate a throttle portion formed in one portion of the internal conductor hole. In a dielectric resonator having such a narrower or throttle portion in one portion of an internal conductor hole, near one opening of the internal conductor hole, an internal conductor formed on the inside surface of the throttle portion is removed with the use of a grinding tool or the like, as shown in FIG. 27, so as to form an open portion in the internal conductor and effect a characteristic adjustment. In FIG. 27, reference character A shows the removed portions. In this manner, electromagnetic field leakage is reduced by forming the open portion of the internal conductor in a location spaced away from the open face of the dielectric resonator. The adjusting operation is simplified, and the adjusting accuracy is also improved, as the grinding range for the grinding tool is restricted to the throttle portion.

Although the sixth through the ninth embodiments each have two superposed dielectric plates, the construction and the characteristic adjustment methods of the sixth through the ninth embodiments can be applied in the same manner even to an integral type dielectric resonator with an internal conductor hole being provided in a single dielectric block as in the first through the fifth embodiments.

Further, the construction and characteristic adjustment methods of the first through the fifth embodiments can have two dielectric plates superposed as in the sixth through the ninth embodiments, and can be applied in the same manner even to the dielectric resonator with the internal conductor holes being provided therein.

Although the foregoing embodiments are utilized in comb-line-type dielectric filters as an example, they can be applied to interdigital-type dielectric filters as well.

(Tenth Embodiment)

Figure 28A:
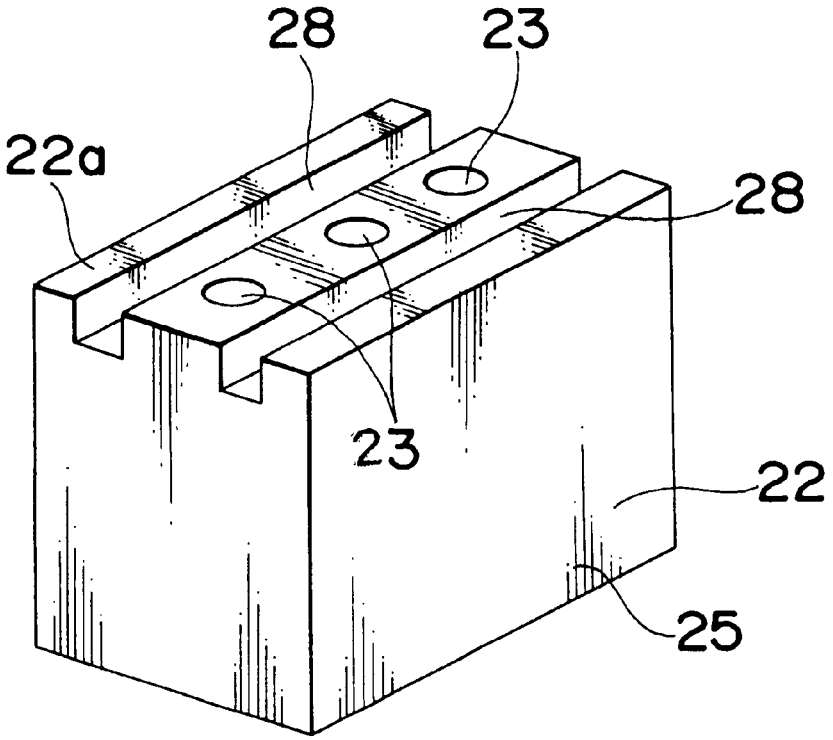
FIG. 28(*a*) and 28(*b*) are a perspective view and a sectional view, respectively, of a dielectric resonator in a tenth embodiment of the present invention.
Figure 28B:
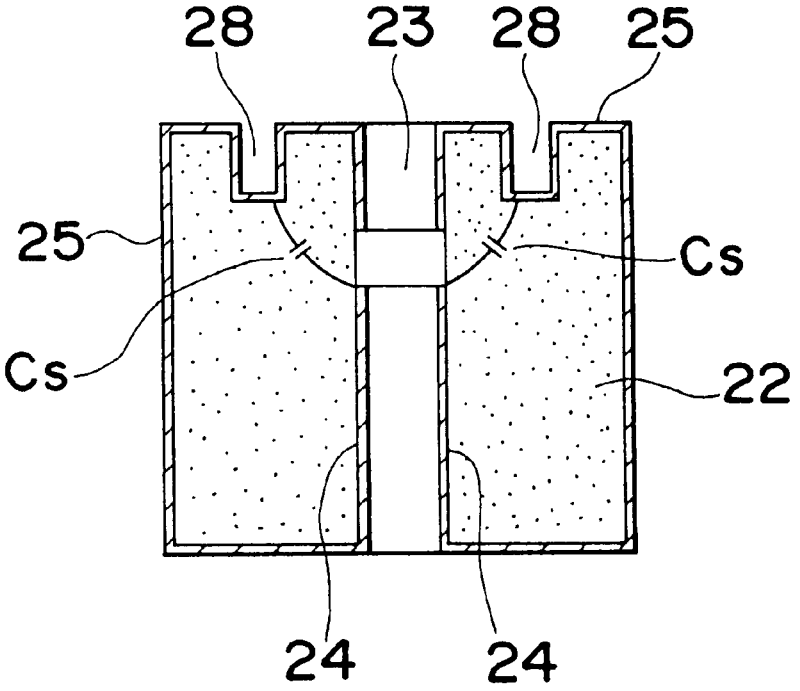

FIG. 28(*a*) shows a tenth embodiment. Slots 28 are formed in the dielectric body with the inside of the slots being approximately parallel with the end face 22*a* of the dielectric 22. The slots 28 are formed on both sides of the holes 23 which have an inside conductor 24 formed on the inside surface of the dielectric 22. An outside conductor 25 is formed across the entire outside surface of the dielectric 22, including the slots 28. Accordingly, the distance between the outside conductor 25, which becomes an earth electrode and is connected to the bottom portions of the slots 28, and the inside conductor 24, becomes shorter as shown in FIG. 28(*b*), so that floating capacitance Cs can be easily obtained.

The slots 28 can be worked into the dielectric 22 or formed in it by a molding operation. Accordingly, the floating capacitance cs can be obtained by a comparatively simple working operation or molding operation. The size of the floating capacitance Cs can be easily adjusted by varying the size and the depth of the slots 28 or by removing one portion of the outside conductor 25.

In the comb-line type filter, the bandwidth of the filter can be made larger by provision of, for example, a larger floating capacitance Cs. The resonator length becomes shorter and the size can be made smaller by provision of the larger floating capacitance Cs. Further, the floating capacitance Cs can be easily obtained, and also, the floating capacitance Cs can be easily adjusted, even in a filter having interdigital coupling.

(Eleventh Embodiment)

Figure 29:
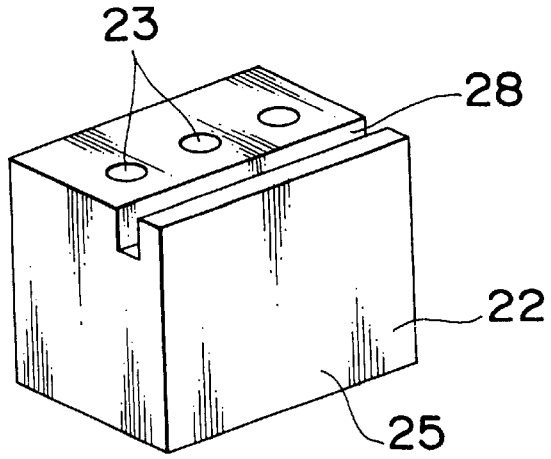
FIG. 29 is a perspective view of a dielectric resonator of an eleventh embodiment of the present invention.

FIG. 29 shows an eleventh embodiment, which is different from the previous embodiment, with a single slot 28 being provided on one side of the dielectric 22. Even in this embodiment, the floating capacitance Cs can be easily obtained and the adjustment can be easily effected as in the previous embodiment.

(Twelfth Embodiment)

Figure 30A:
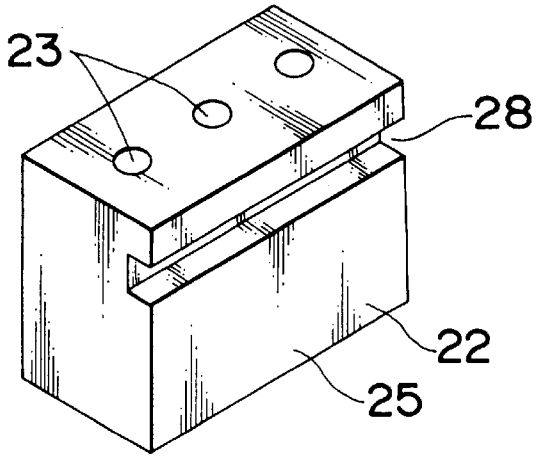
FIGS. 30(*a*) and 30(*b*) are a perspective view and a sectional view, respectively, of a dielectric resonator of a twelfth embodiment.
Figure 30B:
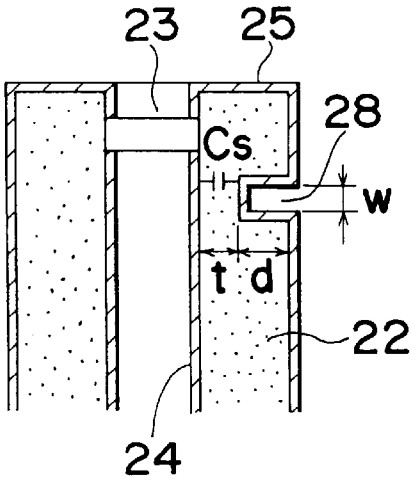

FIGS. 30(*a*) and 30(*b*) show a twelfth embodiment. In this embodiment, the slot 28 is formed on one side face of the dielectric 22. The external conductor 25 at the bottom portion of the slot portion 28 is brought toward the inside conductor 24, which is formed within the hole 23 in the dielectric 22, so as to easily obtain the floating capacitance.

The interval t between the outside conductor 25, which becomes an earth electrode, and the inside conductor 24, the width w and the depth d of the slot 28 and so on may be changed so as to control the floating capacitance Cs.

The coupling between the resonators can be adjusted by the adjustment of the floating capacitance Cs. The passband of the filter can be controlled without additional changes. The above described floating capacitance Cs can be made larger by adjusting the slot 28.

The shape of the dielectric resonator can be standardized, so the metal mold cost and the management cost can be reduced. In a modification of the embodiment shown in FIGS. 30(*a*) and 30(*b*), the slot 28, which is formed on one side face of the dielectric 22, may instead be formed on both the side faces of the dielectric 22. In this case, the floating capacitance Cs can be equalized on the two sides.

(Thirteenth Embodiment)

Figure 31:
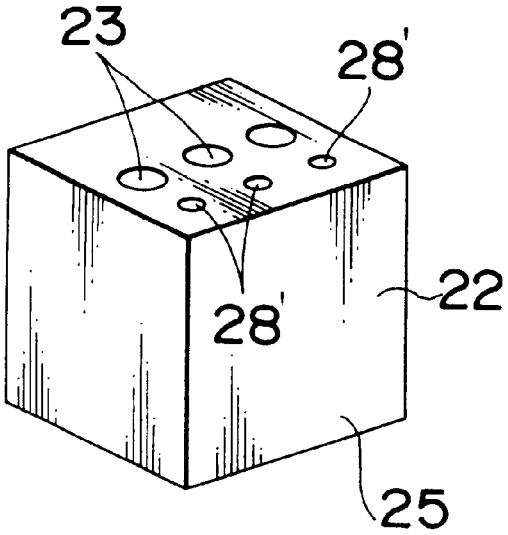
FIGS. 31(*a*) and 31(*b*) are a perspective view and a sectional view, respectively, of a dielectric resonator of a thirteenth embodiment.
Figure 31:
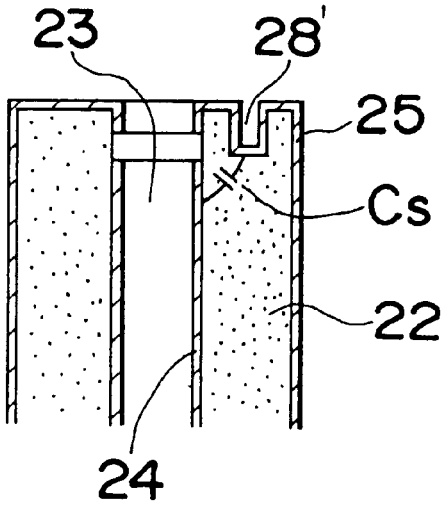

FIGS. 31(*a*) and 31(*b*) show a thirteenth embodiment. Round hole portions 28 are formed, in the same direction, near the holes 23. The hole portions 28 in this embodiment are respectively formed in accordance with the number of holes 23. Alternatively, the number of hole portions 28 formed may be one, or the number of hole portions 28 may be more than the number of the holes 23. The hole portions 28 may be provided correspondingly on both sides of the holes 23. Many hole portions 28 may be formed.

(Fourteenth Embodiment)

Figure 32:
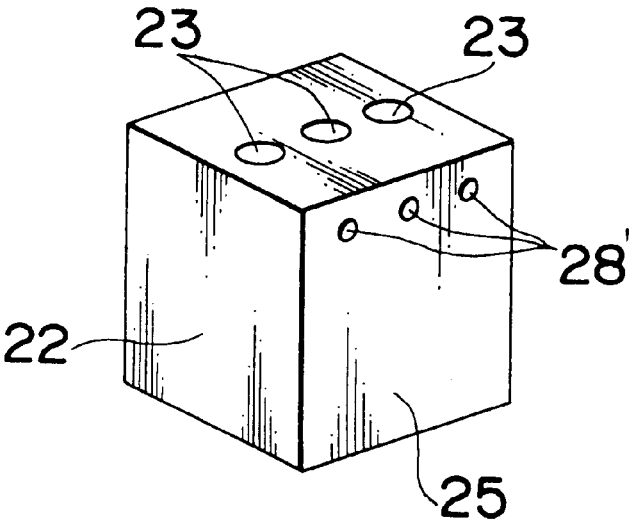
FIGS. 32(*a*) and 32(*b*) are a perspective view and a sectional view, respectively, of a dielectric resonator of a fourteenth embodiment.
Figure 32:
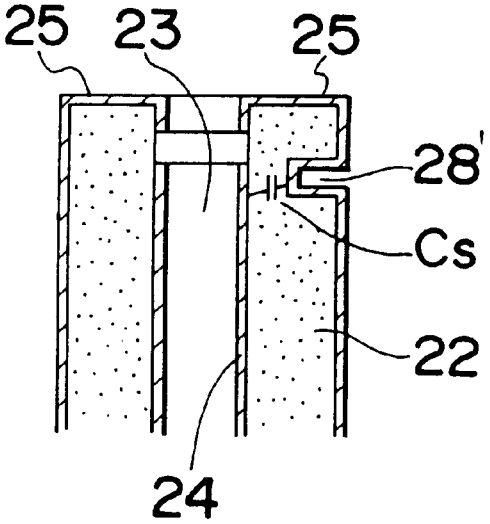

FIGS. 32(*a*) and 32(*b*) show a fourteenth embodiment. In this embodiment, the round hole portions 28 are formed on the side face of the dielectric 22. The external conductor 25 at the bottom portion of the hole portions 28 is brought near and parallel to the internal conductor 24. In this embodiment, the hole portions 28 are formed so as to correspond to the holes 23. Also, the number of the hole portions 28 may be one or may be three or more. In addition, the hole portions 28 may be formed in either face of the dielectric 22.

(Fifteenth Embodiment)

Figure 33A:
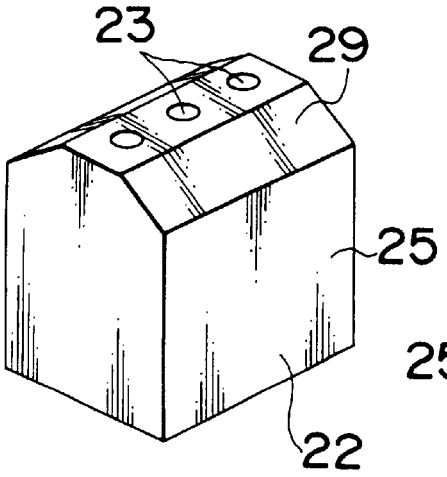
FIG. 33(*a*) and 33(*b*) are a perspective view and a sectional view, respectively, of a dielectric resonator of a fifteenth embodiment of the present invention.
Figure 33B:
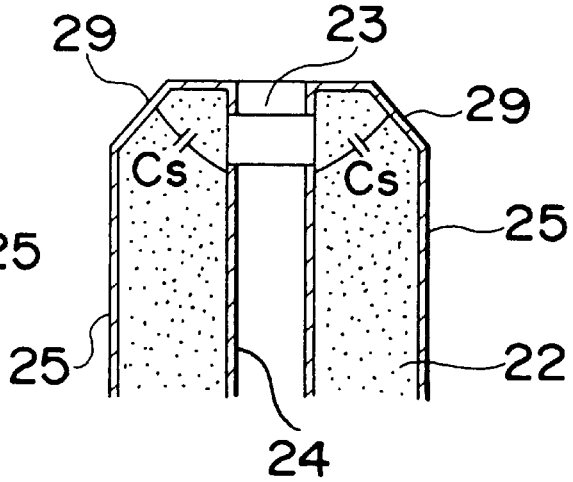

FIGS. 33(*a*) and 33(*b*) show a fifteenth embodiment. Slope or taper portions 29 are formed on both the side edge portions of the open face 23 of the dielectric 22, as shown in FIG. 33(*a*). The taper portions 29 are formed so that the distance is reduced between the internal conductor 24, within the hole 23, and the external conductor 25 on the taper portions 29, which serves as an earth electrode, and the floating capacitance Cs can therefore be easily obtained as in the above described embodiments.

The size of the floating capacitance Cs can be easily adjusted by the slope or the angle of the taper portions 29 and the size of the taper portions 29. The taper portion 29 is formed at an angle at the edges of the open face so that the floating capacitance Cs may be obtained.

(Sixteenth Embodiment)

Figure 34:
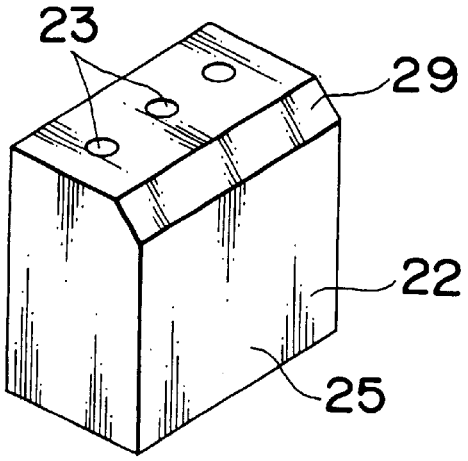
FIG. 34 is a perspective view of a dielectric resonator of a sixteenth embodiment.

FIG. 34 shows a sixteenth embodiment where a taper portion 29 is formed on a single side of the dielectric 22. Even in this embodiment, the floating capacitance Cs can be easily obtained by the taper portion 29.

(Seventeenth Embodiment)

Figure 35:
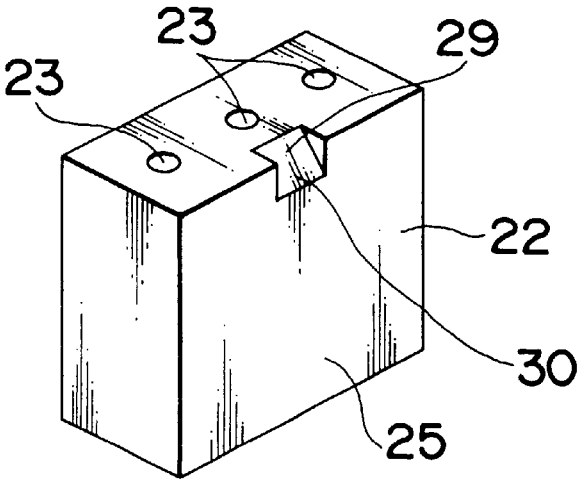
FIG. 35 is a perspective view of a dielectric resonator of a seventeenth embodiment.

FIG. 35 shows a seventeenth embodiment. In the present embodiment, a smaller taper or slope portion 29 is formed in a limited portion instead of along the whole edge or corner of the dielectric 22. In FIG. 35, a slotted portion 30 with a taper portion 29 being formed therein is formed on only one portion of an edge of the dielectric 22. One or more additional portions 30 may be formed on the same side or on more than one side of the dielectric resonator in accordance with the respective holes 23. The number of the slotted portions 30 is not restricted.

The floating capacitance Cs can be easily adjusted by the position and size of the slotted portions 30.

(Eighteenth Embodiment)

Figure 36:
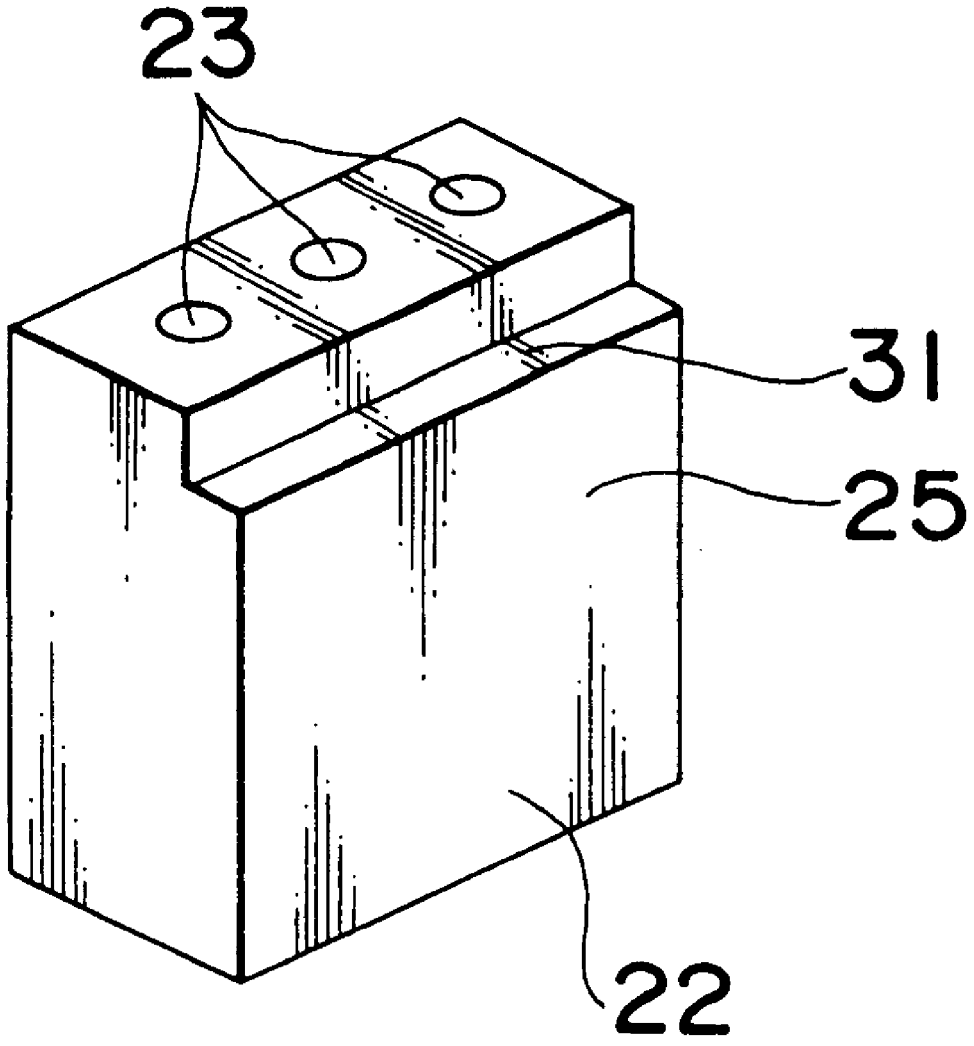
FIG. 36 is a perspective view of a dielectric resonator of an eighteenth embodiment of the present invention.

FIG. 36 is an eighteenth embodiment, where an approximately L-shaped stepped portion 31 is formed, instead of the taper or slotted shaped section formed in the previous embodiments, on an edge portion of a single side (or both sides in a modification of the Fifteenth Embodiment) of the top face of the dielectric 22. Even in this case, the distance is reduced between the inside conductor 24 within the hole 23 and the outside conductor 25 in the stepped portion 31, which becomes an earth electrode, so that the floating capacitance Cs can be easily obtained.

Although the stepped portion 31 is continuously formed along one edge, as shown in FIG. 36, it may be formed non-continuously, in one portion or intermittent portions, or along the edges on both sides of the dielectric 22. The size of the floating capacitance can be easily adjusted by the size and/or the number of the stepped portions 31.

(Nineteenth Embodiment)

Figure 37:
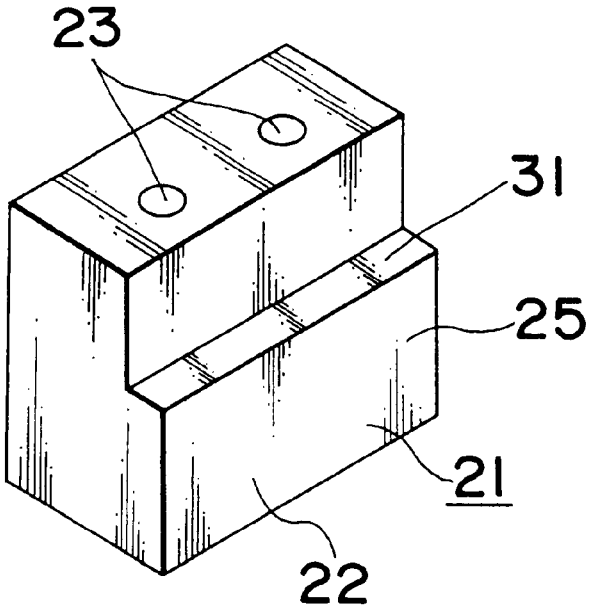
FIG. 37 is a perspective view of a dielectric resonator of a nineteenth embodiment.
Figure 38:
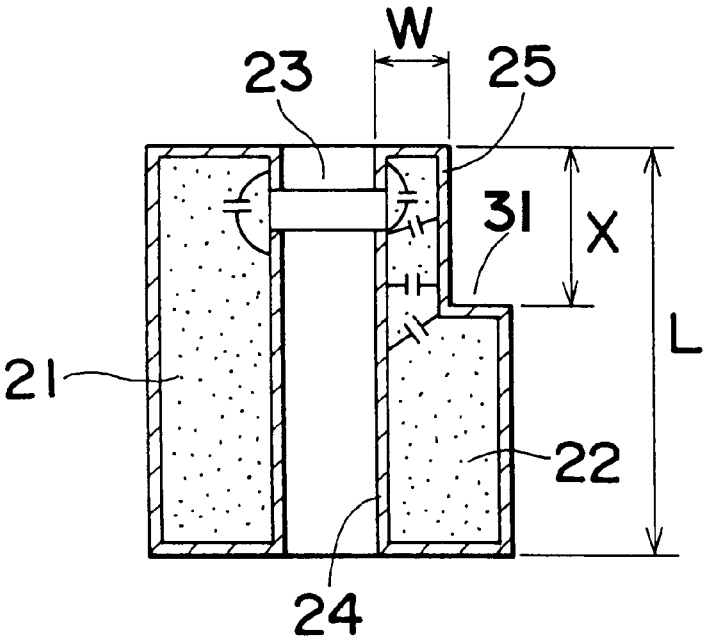
FIG. 38 is a sectional view of a dielectric resonator of a twentieth embodiment.
Figure 39:
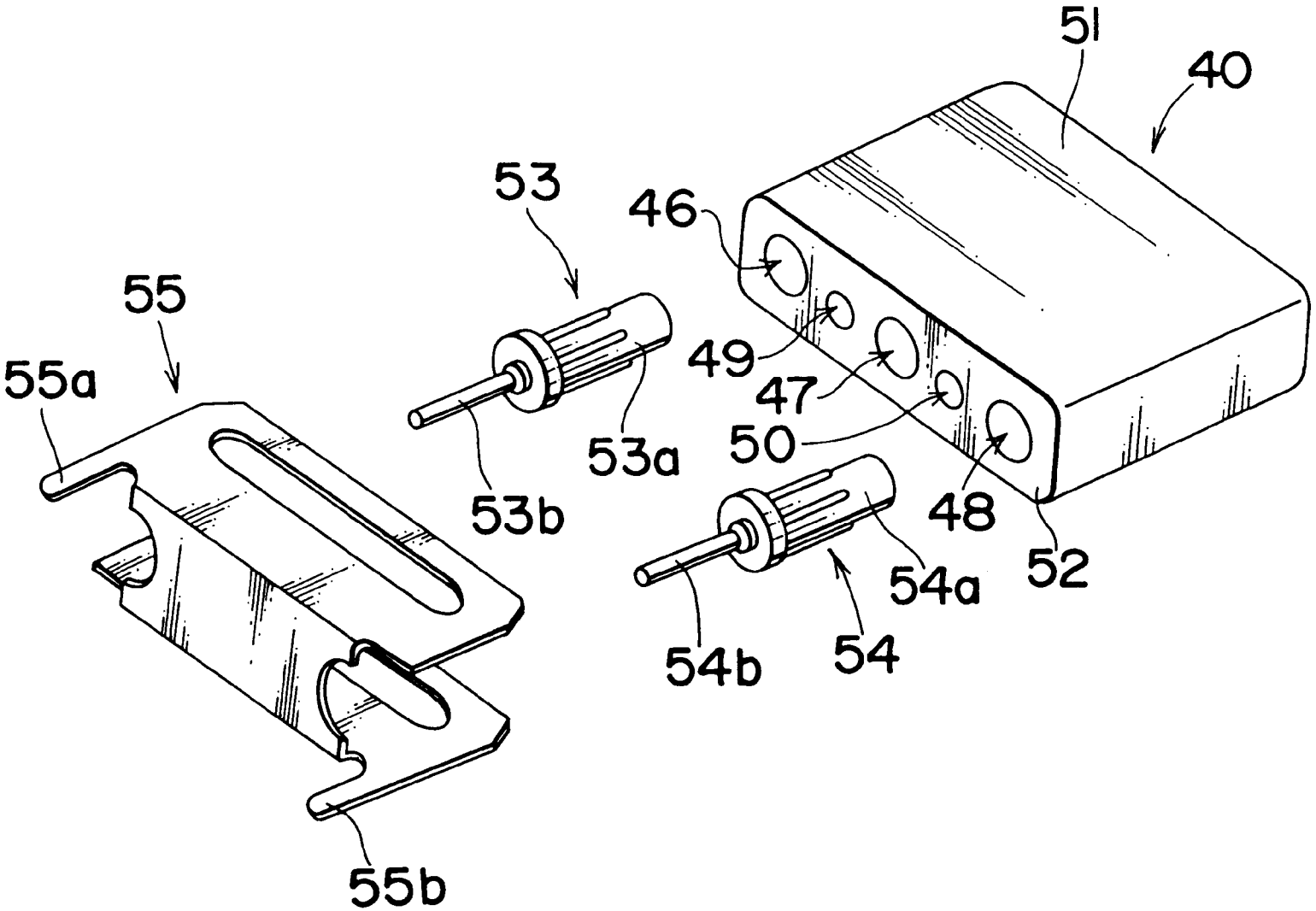
Fig. 39 PRIOR ART
FIG. 39 is an exploded perspective view of a conventional dielectric resonator.

The nineteenth embodiment, shown in FIG. 37 and FIG. 38, has a stepped portion 31 which is further deepened along the side of the dielectric resonator as compared with the case of the above described eighteenth embodiment. In an integrated type of dielectric resonator, the floating capacitance Cs is obtained by the inside conductor 24, and the stepped portion 31 is formed in a dielectric filter which is comb-line coupled so that the outside conductor 25 is brought closer to the inside conductor 24 within the hole 23 so as to increase the floating capacitance Cs.

The thickness W and the depth X of the stepped portion 31 are adjusted so as to adjust the coupling. If the size of the dielectric 22 in the axial direction of the hole 23 is L, then $0 \leqq X < L$.

The coupling coefficients of the dielectric resonator can be changed by changing the above described sizes X, W so that the passband of the filter can be controlled without changing the overall shape of the dielectric resonator (and its corresponding metal mold). The shape of the dielectric resonator can be therefore standardized, and the metallic materials cost and the management cost can be reduced.

As a large coupling coefficient can be obtained without the pitch between the holes 23 being narrowed, the attenuation pole at the higher frequency side of the passband is becomes far from the passband, and the attenuation characteristic at the lower frequency side of the passband is improved. The resonance electrode length becomes shorter when the floating capacitance Cs is increased, so that the filter can be made smaller in size. Further, a filter having a broader band is obtained.

The dielectric resonator in each of the above described embodiments is not restricted to the number of the stages shown, although the three-stage construction has been described. Namely, it can be applied to a dielectric resonator of one, two, three stages or more.

The dielectric resonator of the present invention can be applied to any type of filter such as a band pass filter, band elimination filter, high-pass filter, low-pass filter and so on.

As is clear from the foregoing description, according to the arrangement of the present invention, the dielectric resonator of the present invention can be mounted on the surface of a circuit substrate without the use of special individual signal input, output terminals since the signal input, output electrodes are provided on the external conductor. Moreover, since the conductor is formed on the both end faces of the internal conductor hole so as to eliminate the open face, electromagnetic field leakage is reduced so to reduce the above described influences of electromagnetic field leakage, even if the dielectric resonator is mounted on the circuit substrate without any modification.

According to the dielectric resonator of the present invention, coupling coefficients between the resonators and the resonator frequency of each resonator can be adjusted without the addition of coatings and so on, by the non-conductive portions formed in the internal conductors.

According to the dielectric resonator of the present invention, the open portion of the internal conductor is formed in a location spaced away from the open face of the internal conductor holes, and therefore, the disadvantages of electromagnetic field leakage are lessened. Therefore, no coupling is created between the resonator, other objects near the resonator, and the circuit, so that stable resonator characteristics are provided.

As is clear from the characteristic adjusting method for the dielectric resonator of the present invention, an open portion is formed in one portion of the internal conductor only by the movement of a grinding tool in the axial direction of the internal conductor hole, with the locations where the internal conductor and the dielectric are removed being restricted to that location. Also, the tip end capacitance is easily adjusted by the amount the grinding tool is moved. Further, a dielectric resonator having a desired resonance frequency and coupling amount can be easily obtained without demanding higher accuracy in the grinding or working operation, because the tip end capacitance is only gradually lowered in response to the grinding of the dielectric.

In a dielectric resonator which is resonant at a desired frequency having an inside conductor formed on the inside surface of at least one hole in the dielectric and an outside conductor formed on the outside surface of the above described dielectric, a concave or depressed portion is formed on the surface of the above described dielectric, so that the outside conductor on the bottom portion of the concave or depressed portion is brought closer to the above described inside conductor so as to reduce the distance between the inside conductor of the hole in the interior of the dielectric and the outside conductor, which becomes an earth electrode. Thus, it is possible to easily obtain the floating capacitance due to the outside conductor at the bottom portion of the concave or depressed portion approaching the above described inside conductor. The floating capacitance can be adjusted by a comparatively simple working or molding operation to adjust the size, depth and so on of the concave or depressed portion. In the comb-line type filter, the bandwidth of the filter can be made larger by provision of, for example, larger floating capacitance. Resonator length becomes shorter by the provision of, for example, the larger floating capacitance with the result that the size may be made smaller.

In the present invention, a taper or sloped portion is formed at the edge portion of the dielectric, so that the outside conductor of the taper or sloped portion is brought closer to the inside conductor. Thus, the distance between the inside conductor of the hole in the interior of the dielectric and the outside conductor, which becomes an earth electrode, is reduced, so that the floating capacitance is easier to obtain. The floating capacitance can be adjusted by a comparatively simple working or molding operation to adjust the size, inclination and so on of the taper or sloped portion of the corner portion. In the comb-line filter, the bandwidth of the filter can be made larger by the provision of, for example, the larger floating capacitance. The resonator length becomes shorter by provision of, for example, the larger floating capacitance so that the size may be made smaller.

In the present invention, a stepped portion which is approximately L-shaped in cross-section is provided at the edge portion of the dielectric, and the outside conductor in the stepped portion is brought closer to the inside conductor so that the distance between the inside conductor of the hole in the interior of the dielectric and the outside conductor, which becomes an earth electrode, is reduced so as to easily obtain the floating capacitance. The floating capacitance can be adjusted by a comparatively simple working or molding operation to set the size, depth and so on of the stepped portion. In the comb-line type filter, the bandwidth of the filter can be widened by provision of, for example, the larger floating capacitance so that the size may be made smaller.

Although embodiments of the present invention have been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. A dielectric filter with surface electromagnetic shielding, comprising;

a dielectric body comprising dielectric material and having an outer surface including two end faces;

an external conductor substantially completely covering the outer surface of the dielectric body so as to provide said surface electromagnetic shielding of said dielectric filter; and a plurality of holes extending through the dielectric body between said two end faces, each hole having a respective inner surface;

at least one hole of said plurality of holes having a respective pair of internal conductors provided in the corresponding hole and conductively connected to said external conductor at respective ends of said corresponding hole, a respective non-conductive portion at said inner surface of the corresponding hole being spaced from both ends of said respective hole and thereby separating said corresponding pair of internal conductors and thereby defining a respective capacitance between said corresponding pair of internal conductors; and signal input and output electrodes provided on the outer surface of the dielectric body and electrically isolated from said external conductor for providing capacitive coupling with respective internal conductors of corresponding ones of the plurality of holes, and closely surrounded by said external conductor for providing capacitive coupling with said external conductor;

wherein one said end face of said dielectric body, where one of said internal conductors in said at least one hole is conductively connected to said external conductor, has a non-conductive portion free of said external conductor, said non-conductive portion being disposed at a location for adjusting at least one of a resonance frequency and a coupling degree of the filter.

2. A dielectric resonator described in accordance with claim 1, wherein said plurality of holes consists of at least two said holes.

3. A dielectric resonator described in accordance with claim 1, further comprising a second non-conductive portion free of said external conductor on the other said end face, said second non-conductive portion being disposed at a location for adjusting at least one of said resonance frequency and said coupling degree of said filter.

4. A dielectric resonator described in accordance with claim 1, wherein said plurality of holes consists of at least two said holes.

5. A dielectric filter with surface electromagnetic shielding, comprising:

a dielectric body comprising dielectric material and having an outer surface including two end faces;

an external conductor substantially completely covering the outer surface of the dielectric body so as to provide said surface electromagnetic shielding of said dielectric filter; and a plurality of holes extending through the dielectric body between said two end faces, each hole having a respective inner surface;

at least one hole of said plurality of holes having a respective pair of internal conductors provided in the corresponding hole and conductively connected to said external conductor at respective ends of said corresponding hole, a respective non-conductive portion at said inner surface of the corresponding hole being spaced from both ends of said respective hole and thereby separating said corresponding pair of internal conductors and thereby defining a respective capacitance between said corresponding pair of internal conductors; and signal input and output electrodes provided on the outer surface of the dielectric body and electrically isolated from said external conductor for providing capacitive coupling with respective internal conductors of corresponding ones of the plurality of holes, and closely surrounded by said external conductor for providing capacitive coupling with said external conductor;

wherein one said end face of said dielectric body, where one of said internal conductors in said at least one hole is conductively connected to said external conductor, has a non-conductive portion free of said external conductor and of said dielectric material, said non-conductive portion being disposed at a location for adjusting at least one of a resonance frequency and a coupling degree of the filter.

6. A dielectric resonator described in accordance with claim 5, wherein said plurality of holes consists of at least two said holes.

7. A dielectric resonator described in accordance with claim 5, further comprising a second non-conductive portion free of said external conductor and said dielectric material on the other said end face, said second non-conductive portion being disposed at a location for adjusting at least one of said resonance frequency and said coupling degree of said filter.

8. A dielectric resonator described in accordance with claim 7, wherein said plurality of holes consists of at least two said holes.

9. A dielectric filter with surface electromagnetic shielding, comprising:

a dielectric body comprising dielectric material and having an outer surface including two end faces;

an external conductor substantially completely covering the outer surface of the dielectric body so as to provide said surface electromagnetic shielding of said dielectric filter; and a plurality of holes extending through the dielectric body between said two end faces, each hole having a respective inner surface with a substantially constant cross-sectional shape along an axial direction of the corresponding hole;

at least one hole of said plurality of holes having a respective pair of internal conductors provided in the corresponding hole and conductively connected to said external conductor at respective ends of said corresponding hole, a respective non-conductive portion at said inner surface of the corresponding hole being spaced from both ends of said respective hole and thereby separating said corresponding pair of internal conductors and thereby defining a respective capacitance between said corresponding pair of internal conductors, a surface of said respective non-conductive portion being substantially flush with the rest of said inner surface of the corresponding hole; and signal input and output electrodes provided on the outer surface of the dielectric body and electrically isolated from said external conductor for providing capacitive coupling with respective internal conductors of corresponding ones of the plurality of holes, and closely surrounded by said external conductor for providing capacitive coupling with said external conductor;

wherein one said end face of said dielectric body, where one of said internal conductors in said at least one hole is conductively connected to said external conductor, has a non-conductive portion tree of said external conductor and of said dielectric material, said non-conductive portion being disposed at a location for adjusting at least one of a resonance frequency and a coupling degree of the filter.

10. A dielectric resonator described in accordance with claim 9, wherein said plurality of holes consists of at least two said holes.

11. A dielectric resonator described in accordance with claim 9, further comprising a second non-conductive portion free of said external conductor and said dielectric material on the other said end face, said second non-conductive portion being disposed at a location for adjusting at least one of said resonance frequency and said coupling degree of said filter.

12. A dielectric resonator described in accordance with claim 11, wherein said plurality of holes consists of at least two said holes.

13. A dielectric filter with surface electromagnetic shielding, comprising:

a dielectric body comprising dielectric material and having an outer surface including two end faces;

an external conductor substantially completely covering the outer surface of the dielectric body so as to provide said surface electromagnetic shielding of said dielectric filter; and a plurality of holes extending through the dielectric body between said two end faces, each hole having a respective inner surface with a substantially constant cross-sectional shape along an axial direction of the corresponding hole;

at least one hole or said plurality of holes having a respective pair of internal conductors provided in the corresponding hole and conductively connected to said external conductor at respective ends of said corresponding hole, a respective non-conductive portion at said inner surface of the corresponding hole being spaced from both ends of said respective hole and thereby separating said corresponding pair of internal conductors and thereby defining a respective capacitance between said corresponding pair of internal conductors, a surface of said respective non-conductive portion being substantially flush with the rest of said inner surface of the corresponding hole; and signal input and output electrodes provided on the outer surface of the dielectric body and electrically isolated from said external conductor for providing capacitive coupling with respective internal conductors of corresponding ones of the plurality of holes, and closely surrounded by said external conductor for providing capacitive coupling with said external conductor;

wherein one said end face of said dielectric body, where one of said internal conductors in said at least one hole is conductively connected to said external conductor, has a non-conductive portion free of said external conductor, said non-conductive portion being disposed at a location for adjusting at least one of a resonance frequency and a coupling degree of the filter.

14. A dielectric resonator described in accordance with claim 13, wherein said plurality of holes consists of at least two said holes.

15. A dielectric resonator described in accordance with claim 13, further comprising a second non-conductive portion free of said external conductor on the other said end face, said second non-conductive portion being disposed at a location for adjusting at least one of said resonance frequency and said coupling degree of said filter.

16. A dielectric resonator described in accordance with claim 15, wherein said plurality of holes consists of at least two said holes.

17. A dielectric filter with surface electromagnetic shielding, comprising:

a dielectric body comprising dielectric material and having an outer surface including two end faces;

an external conductor substantially completely covering the outer surface of the dielectric body so as to provide said surface electromagnetic shielding of said dielectric filter; and at least one hole extending through the dielectric body between said two end faces, said at least one hole having a respective inner surface;

said at least one hole having a pair of internal conductors respectively provided in the corresponding hole and conductively connected to said external conductor at respective ends of said corresponding hole, a respective non-conductive portion at said inner surface of the corresponding hole being spaced from both ends of said respective hole and thereby separating said corresponding pair of internal conductors and defining a capacitance between said corresponding pair of internal conductors, a surface of said respective non-conductive portion being substantially flush with a remainder of said inner surface of the corresponding hole; and signal input and output electrodes provided on the outer surface of the dielectric body and electrically isolated from said external conductor for providing capacitive coupling with at least one internal conductor of said at least one hole, and closely surrounded by said external conductor for providing capacitive coupling with said external conductor;

wherein one said end faces of said dielectric body where one of said internal conductors in said at least one hole is conductively connected to said external conductor, has a non- conductive portion free of a portion of said external conductor, said non-conductive portion being disposed at a location for adjusting at least one of a resonance frequency and a coupling degree of the filter.

18. A dielectric filter described in accordance with claim 17, wherein at said one end face of said dielectric body, said non-conductive portion is free of both said portion of said external conductor and a portion of said dielectric material.

19. A dielectric filter described in accordance with claim 18, wherein said respective inner surface of said at least one hole has a substantially constant cross-sectional shape along an axial direction of the corresponding hole.

20. A dielectric resonator described in accordance with claim 17, further comprising a second non-conductive portion free of said portion of said external conductor on the other said end face, said second non-conductive portion being disposed at a location for adjusting at least one of said resonance frequency and said coupling degree of said filter.

21. A dielectric resonator described in accordance with claim 20, wherein said second non-conductive portion on the other said end face is free of both said portion of said external conductor and a portion of said dieletric material.

22. A dielectric filter described in accordance with claim 21, wherein said respective inner surface of said at least one hole has a substantially constant cross-sectional shape along an axial direction of the corresponding hole.

23. A dielectric filter described in accordance with claim 20, wherein said respective inner surface of said at least one hole has a substantially constant cross-sectional shape along an axial directional of the corresponding hole.

24. A dielectric filter described in accordance with claim 17, wherein said respective inner surface of said at least one hole has a substantially constant cross-sectional shape along an axial direction of the corresponding hole.

* * * * *

UNITED STATES PATENT AND TRADEMARK OFFICE

CERTIFICATE OF CORRECTION

PATENT NO : 6,005,456

DATED : December 21, 1999

INVENTOR(S) : Haruo MATSUMOTO et al.

It is certified that error appears in the above identified patent and that said Letters Patent is hereby corrected as shown below.

On the title page, Item [75], please delete "Tatsuya Tsujiguchi" and please delete "Hitoshi Tada".

Signed and Sealed this

Thirteenth Day of February, 2001

*Attest:*

Nicholas P. Godici

NICHOLAS P. GODICI

*Attesting Officer*

*Acting Director of the United States Patent and Trademark Office*